US009461368B2

(12) United States Patent
Azulay et al.

(10) Patent No.: US 9,461,368 B2
(45) Date of Patent: Oct. 4, 2016

(54) BROADBAND DUAL-POLARIZED ANTENNA

(75) Inventors: Snir Azulay, Tiberias (IL); Ruvim Goldman, Nazareth Illit (IL); Anatoly Berezin, Tiberias (IL); Yaniv Ziv, Tiberias (IL); Haim Yona, Givat Avni (IL); Shay Mamo, Tiberias (IL); Ilan Shtrikman, Tiberias (IL)

(73) Assignee: GALTRONICS CORPORATION, LTD., Tiberias (IL)

( * ) Notice: Subject to any disclaimer, the term of this patent is extended or adjusted under 35 U.S.C. 154(b) by 422 days.

(21) Appl. No.: 13/981,752

(22) PCT Filed: Jan. 26, 2012

(86) PCT No.: PCT/IL2012/000043

§ 371 (c)(1),
(2), (4) Date: Oct. 3, 2013

(87) PCT Pub. No.: WO2012/101633

PCT Pub. Date: Aug. 2, 2012

(65) Prior Publication Data

US 2014/0022131 A1 Jan. 23, 2014

Related U.S. Application Data

(60) Provisional application No. 61/436,645, filed on Jan. 27, 2011.

(51) Int. Cl.
*H01Q 21/26* (2006.01)
*H01Q 21/24* (2006.01)
(Continued)

(52) U.S. Cl.
CPC ..... *H01Q 21/24* (2013.01); *H01Q 1/007* (2013.01); *H01Q 21/205* (2013.01); *H01Q 21/28* (2013.01)

(58) Field of Classification Search
CPC ..... H01Q 21/26; H01Q 13/10; H01Q 21/24; H01Q 19/24; H01Q 25/001
USPC ..... 343/797, 793, 795, 799, 794, 727, 854
See application file for complete search history.

(56) References Cited

U.S. PATENT DOCUMENTS 4,814,777 A 3/1989 Monser
5,264,861 A 11/1993 Roederer et al.
(Continued)

FOREIGN PATENT DOCUMENTS

CN 1792006 A 6/2006
JP 4066963 B2 3/2008
WO 2012/101633 8/2012

OTHER PUBLICATIONS

U.S. Appl. No. 61/436,645, filed Jan. 27, 2011.
(Continued)

*Primary Examiner* — Dameon E Levi
*Assistant Examiner* — Collin Dawkins
(74) *Attorney, Agent, or Firm* — Lorenz & Kopf, LLP.

(57) ABSTRACT

An antenna, including a broadband vertically polarized monopole radiating element, a reflector having a projection in a first plane generally perpendicular to a vertical axis of the monopole radiating element, a plurality of horizontally polarized radiating elements arranged generally concentrically with respect to the monopole radiating element, each one of the horizontally polarized radiating elements having a projection in a second plane generally perpendicular to the vertical axis, the second plane being offset from the first plane in a direction along the vertical axis and a feed arrangement for feeding the monopole and horizontally polarized radiating elements.

19 Claims, 24 Drawing Sheets

(51) Int. Cl.

| | |
|---|---|
| ***H01Q 1/00*** | (2006.01) |
| ***H01Q 21/20*** | (2006.01) |
| ***H01Q 21/28*** | (2006.01) |

(56) References Cited

U.S. PATENT DOCUMENTS

| | | | | |
|---|---|---|---|---|
| 5,760,750 | A | 6/1998 | Guertin | |
| 5,940,048 | A | 8/1999 | Martek | |
| 6,034,649 | A | 3/2000 | Wilson | |
| 6,259,418 | B1 | 7/2001 | Jones | |
| 6,281,849 | B1 | 8/2001 | Brachat | |
| 6,404,396 | B1 | 6/2002 | Hung | |
| 6,518,929 | B1 | 2/2003 | Gilmore | |
| 6,529,172 | B2 | 3/2003 | Zimmerman | |
| 6,573,876 | B1 | 6/2003 | Maroko | |
| 6,693,600 | B1 | 2/2004 | Elliot | |
| 6,741,210 | B2 | 5/2004 | Brachat | |
| 6,980,166 | B2 | 12/2005 | Gilmore | |
| 6,980,167 | B2 | 12/2005 | Brachat | |
| 7,006,047 | B2 | 2/2006 | Marsan | |
| 7,023,396 | B2 | 4/2006 | Thudor | |
| 7,027,004 | B2 | 4/2006 | Haunberger | |
| 7,064,725 | B2 | 6/2006 | Shtrikman et al. | |
| 7,091,907 | B2 | 8/2006 | Brachat | |
| 7,138,952 | B2 | 11/2006 | Mcgrath | |
| 7,283,101 | B2 | 10/2007 | Bisiules | |
| 7,339,542 | B2 | 3/2008 | Lalezari | |
| 7,405,710 | B2 | 7/2008 | Bisiules | |
| 7,688,273 | B2 | 3/2010 | Montgomery | |
| 2005/0200543 | A1* | 9/2005 | Shtrikman | H01Q 13/10 343/767 |
| 2006/0232489 | A1 | 10/2006 | Bisiules | |
| 2006/0232490 | A1 | 10/2006 | Bisiules | |
| 2007/0132650 | A1 | 6/2007 | Lalezari | |
| 2008/0030418 | A1 | 2/2008 | Brachat | |
| 2009/0040125 | A1* | 2/2009 | Azulay | H01Q 1/243 343/829 |
| 2009/0073072 | A1* | 3/2009 | Lindenmeier | H01Q 1/3275 343/810 |
| 2010/0097286 | A1 | 4/2010 | Morrow | |
| 2010/0253587 | A1 | 10/2010 | Lindenmeier et al. | |
| 2010/0289705 | A1 | 11/2010 | Shtrom et al. | |

OTHER PUBLICATIONS

An International Search Report and a Written Opinion both dated May 21, 2012, which issued during the prosecution of Applicant's PCT/IL2012/000043.

An International Preliminary Report on Patentability dated Jul. 30, 2013, which issued during the prosecution of Applicant's PCT/IL2012/000043.

N. J. McEwan et. al., "A New Design of Horizontally Polarized and Dual-Polarized Uni-Planar Conical Beam Antennas for HYPERLAN", IEEE Transactions on Antennas and Propagation, 51(2), 2003.

Luk et. al., 'A Wide-Band Low-Profile Conical Beam Antenna with Horizontal Polarization for Indoor Wireless Communication', IEEE Antennas and Wireless Propagation Letters, Aug. 2009.

Nobuhiro et. al., "A Notch Wire Composite Antenna for Polarization Diversity Reception", K. IEEE Transactions on Antennas and Propagation, Jun. 1998.

A. N. Gonzalez 'Dual Polarized Omnidirectional Array Element for MIMO Systems', KTH Signals, Sensors and Systems, 2005.

Z. Y. Zhang et. al., 'A Shorted Magneto-Electric Dipole with J-Shaped Strip Feed', Progress in Electromagnetics Research Letters, Dec. 2009.

D. Skaufel, 'Dual Polarized Omnidirectional Antenna',Master's Degree Project, KTH Signals, Sensors and Systems, 2005.

A. Ezzeldin et. al.,'Dual-Polarized Omnidirectional Planar Slot Antenna for WLAN Applications', IEEE Transactions on Antennas and Propagation, 53 (9), 2005.

Hanqing et. al., 'A Wideband E Plane Omnidirectional Antenna', $7^{th}$ International Symposium on Antennas, Propagation and EM Theory, 2006.

C. C. Lin et. al., 'A Horizontally Polarized Omnidirectional Printed Antenna for WLAN Applications', IEEE Transactions on Antennas and Propagation , 54 (11), 2006.

C. C. Lin et. al., 'A 2.4GHz Omni-directional Horizontally Polarized Planar Printed Antenna for WLAN Applications', Antennas and Propagation Society International Symposium, 2003.

B. Wu et. al., 'A Broadband Dual-Polarized Magneto-Electric Dipole Antenna With Simple Feeds', IEEE Antennas and Wireless Propagation Letters, Aug. 2009.

S. Yang et. al., 'A Dual-Polarized Antenna with Pattern Diversity', IEEE Antennas and Propagation Magazine, Jun. 2008.

J. Kim et. al., 'Wide Band Coplanar Waveguide-Fed Monopole Antenna', Proceedings of EuCap, 2006.

I. Shtrikman et. al., 'Conical-Beam Horizontally Polarized Cross-Slot Antenna', $3^{rd}$ International Conference on Computational Electromagnetics and its Applications, 2004.

E. Antonino et. al.,'Design of Very Wide-band Linear-Polarized Antennas', Journnes International Sur Antennas, 2004.

N. Prasad, 'Wide-Band Planar Monopole Antennas', IEEE Transactions on Antennas and Propagation, 46(2), 1998.

N. Behdad et. al., 'A Wide-Band Slot Antenna Design Employing a Fictitious Short Circuit Concept', IEEE Transactions on Antennas and Propagation, 53, 2005.

M Leib et. al., 'A Microstrip-Fed Ultra-Wideband Slot Antenna', Antennas and Propagation Society International Symposium, 2009.

E. Gueguen et. al., 'A Low Cost UWB Printed Dipole Antenna with High Performances', IEEE International Conference on Ultra-Wideband, 2005.

D. S. Kim et. al., 'A Windmill-shaped Loop Antenna for Polarization Diversity', Antennas and Propagation Society International Symposium, 2007.

C. R. Medeiros et. al., 'Wideband Slot Antenna for WLAN Access Points', IEEE Antennas and Wireless Propagation Letters, Sep. 2010.

P. Brachat et al., 'Reseau d'antennes a 6 capteurs en diversite de polarisation', $13^{th}$ International Symposium on Antennas, 2004 (with English Abstract).

A. N. Gonzalez, et. al.,'The Effect of Antenna Orientation and Polarization on MIMO Capacity', Antennas and Propagation Society International Symposium, 2005.

K. Wong, High Performance UWB Planar Antenna Design, Converge—Applications Workshop for High-Performance Design, 2005.

Communication dated May 27, 2015 from the State Intellectual Property Office of the People's Republic of China in counterpart application No. 201280011139.5.

An Office Action dated Mar. 4, 2014 which issued during the prosecution of New Zealand Patent Application No. 614056.

An Office Action dated Feb. 17, 2015 which issued during the prosecution of Australian Patent Application No. 2012210173.

An Office Action dated Dec. 6, 2014 which issued during the prosecution of Australian Patent Application No. 2012210173.

An Office Action dated Jan. 29, 2015 which issued during the prosecution of Mexican Patent Application No. MX/a/2013/008637.

* cited by examiner

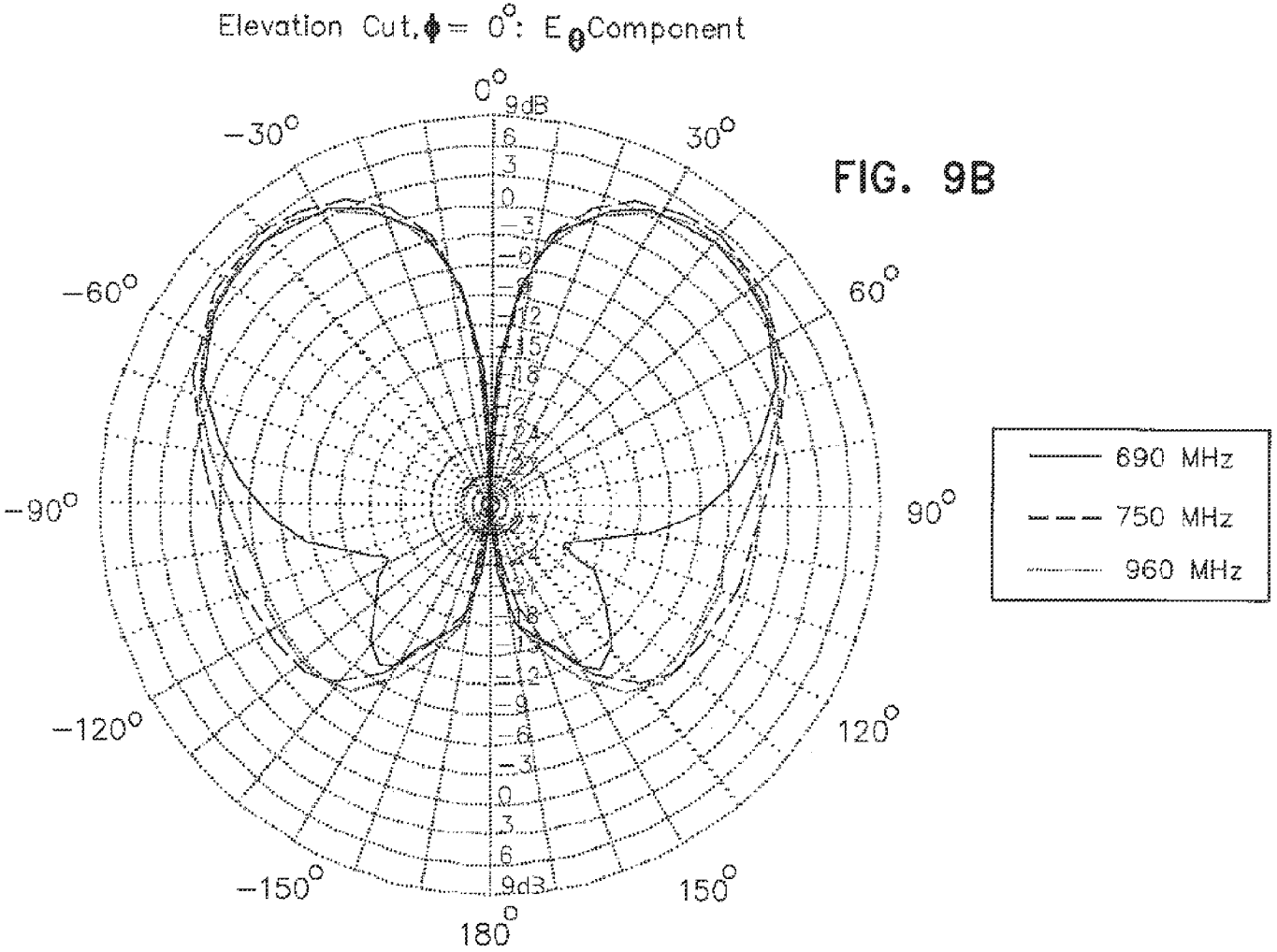
Elevation Cut, $\phi$ = 0°: $E_\theta$ Component
890 MHz
750 MHz
960 MHz
0°
30°
60°
90°
120°
150°
180°
−150°
−120°
−90°
−60°
−30°
9dB
6
3
0
−3
−6
−9
−12
−15
−18
−21
−24
−27
−30
−33
−36
−39
−42
−45
−48
−51
−54
−57
−60
−63
−66
−69
−72
−75
−78
−81
−84
−87
−90
−93
−96
−99
−102
−105
−108
−111
−114
−117
−120

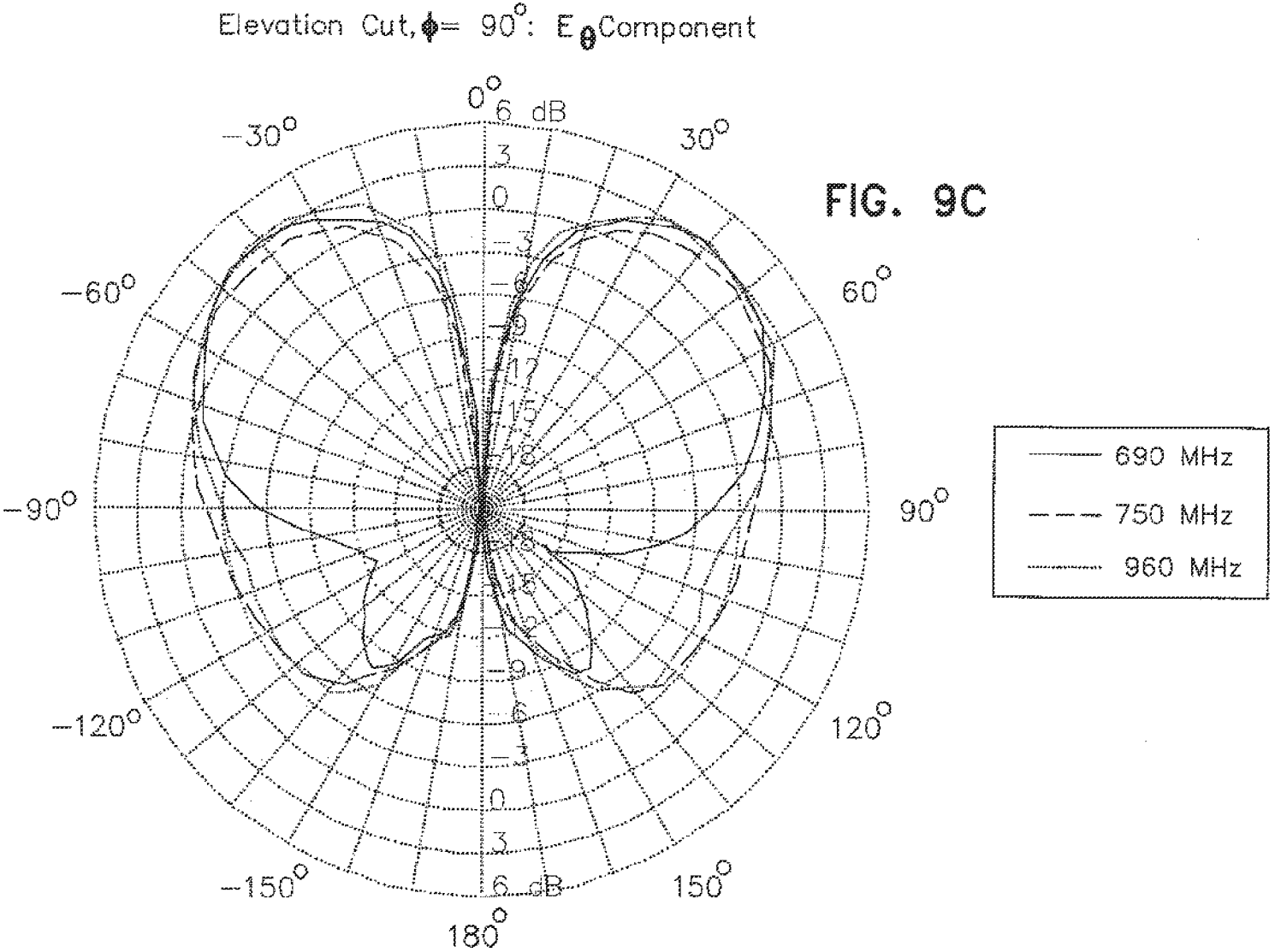
Elevation Cut, $\phi$ = 90°: $E_\theta$ Component
690 MHz
750 MHz
960 MHz
0°
30°
60°
90°
120°
150°
180°
−150°
−120°
−90°
−60°
−30°
6 dB
3
0
−3
−6
−9
−12
−15
−18
−21
−24
−27
−30
−33
−36
−39
−42
−45
−48
−51
−54
−57
−60
−63
−66
−69
−72
−75
−78
−81
−84
−87
−90
−93
−96
−99
−102
−105
−108
−111
−114
−117
−120

BROADBAND DUAL-POLARIZED ANTENNA

CROSS REFERENCE TO RELATED APPLICATIONS

This application is a National Stage of International Application No. PCT/IL2012/000043filed Jan. 26, 2012, claiming priority based on U.S Provisional Application No. 61/436,645 filed Jan. 27, 2011, the contents of all of which are incorporated herein by reference in their entirety.

FIELD OF THE INVENTION

The present invention relates generally to antennas and more particularly to dual-polarized antennas for wireless communication.

BACKGROUND OF THE INVENTION

The following publications are believed to represent the current state of the art:

'A New Design of Horizontally Polarized and Dual-Polarized Uni-Planar Conical Beam Antennas for HYPERLAN', N. J. McEwan et. al., IEEE Transactions on Antennas and Propagation, 51(2), 2003;

'A Wide-Band Low-Profile Conical Beam Antenna with Horizontal Polarization for Indoor Wireless Communication', K. M. Luk et. al., IEEE Antennas and Wireless Propagation Letters, 8, 2009;

'A Notch Wire Composite Antenna for Polarization Diversity Reception', K. Nobuhiro et. al., IEEE Transactions on Antennas and Propagation, June 1998;

'Dual Polarized Omnidirectional Array Element for MIMO Systems', A. N. Gonzalez, KTH Signals, Sensors and Systems, 2005.

'A Shorted Magneto-Electric Dipole with J-Shaped Strip Feed', Z. Y. Zhang et. al., Progress In Electromagnetics Research Letters, 12, 2009;

'Dual Polarized Omnidirectional Antenna', D. Skaufel, Master's Degree Project, KTH Signals, Sensors and Systems, 2005;

'Dual-Polarized Omnidirectional Planar Slot Antenna for WLAN Applications', A. Ezzeldin et. al., IEEE Transactions on Antennas and Propagation, 53 (9), 2005;

'A Wideband E Plane Omnidirectional Antenna', M. Hanging et. al., 7th International Symposium on Antennas, Propagation and EM Theory, 2006;

'A Horizontally Polarized Omnidirectional Printed Antenna for WLAN Applications', C. C. Lin et. al., IEEE Transactions on Antennas and Propagation, 54 (11), 2006;

'A 2.4 GHz Omni-directional Horizontally Polarized Planar Printed Antenna for WLAN Applications', C. C. Lin et. al., Antennas and Propagation Society International Symposium, 2003;

'A Broadband Dual-Polarized Magneto-Electric Dipole Antenna With Simple Feeds', B. Wu et. al., IEEE Antennas and Wireless Propagation Letters, 8, 2009;

'A Dual-Polarized Antenna with Pattern Diversity', S. Yang et. al., IEEE Antennas and Propagation Magazine, 6, 2008;

'Wide Band Coplanar Waveguide-Fed Monopole Antenna', J. Kim et. al., Proceedings of EuCap, 2006;

'Conical-Beam Horizontally Polarized Cross-Slot Antenna', I. Shtrikman et. al., 3rd International Conference on Computational Electromagnetics and Its Applications, 2004;

'Design of Very Wide-band Linear-Polarized Antennas', E. Antonino et. al., Journnes International Sur Antennas, 2004;

'Wide-Band Planar Monopole Antennas', N. Prasad, IEEE Transactions on Antennas and Propagation, 46(2), 1998;

'A Wide-Band Slot Antenna Design Employing A Fictitious Short Circuit Concept', N. Behdad et. al., IEEE Transactions on Antennas and Propagation, 53, 2005;

'A Microstrip-Fed Ultra-Wideband Slot Antenna', M Leib et. al., Antennas and Propagation Society International Symposium, 2009;

'A Low Cost UWB Printed Dipole Antenna with High Performances', E. Gueguen et. al., IEEE International Conference on Ultra-Wideband, 2005;

'A Windmill-shaped Loop Antenna for Polarization Diversity', D. S. Kim et. al., Antennas and Propagation Society International Symposium, 2007;

'Wideband Slot Antenna for WLAN Access Points', C. R. Medeiros et. al., IEEE Antennas and Wireless Propagation Letters, 9, 2010;

'Reseau d'antennes a 6 capteurs en diversite de polarisation', P. Brachat et. al., 13th International Symposium on Antennas, 2004;

'The Effect of Antenna Orientation and Polarization on MIMO Capacity', A. N. Gonzalez, et. al., Antennas and Propagation Society International Symposium, 2005;

'High Performance UWB Planar Antenna Design', K. Wong, CONVERGE—Applications Workshop for High—Performance Design, 2005;

U.S. Pat. Nos. 4,814,777; 5,760,750; 5,940,048; 6,034,649; 6,259,418; 6,281,849; 6,404,396; 6,518,929; 6,529,172; 6,573,876; 6,741,210; 6,693,600; 6,980,166; 6,980,167; 7,064,725; 7,006,047; 7,023,396; 7,027,004; 7,091,907; 7,138,952; 7,283,101; 7,405,710; and 7,688,273; and U.S. Published Application Nos.: 2006/0232490; 2006/0232489; 2008/0030418; and 2010/0097286.

SUMMARY OF THE INVENTION

The present invention seeks to provide a novel compact broadband dual-polarized antenna, particularly suited for multiple-input multiple-output (MIMO) performance.

There is thus provided in accordance with a preferred embodiment of the present invention an antenna, including a broadband vertically polarized monopole radiating element, a reflector having a projection in a first plane generally perpendicular to a vertical axis of the monopole radiating element, a plurality of horizontally polarized radiating elements arranged generally concentrically with respect to the monopole radiating element, each one of the horizontally polarized radiating elements having a projection in a second plane generally perpendicular to the vertical axis, the second plane being offset from the first plane in a direction along the vertical axis and a feed arrangement for feeding the monopole and horizontally polarized radiating elements.

In accordance with a preferred embodiment of the present invention, the monopole radiating element includes a conical radiating element.

Preferably, the conical radiating element includes an upper conductive cylindrical element and a lower conductive conical element, the upper cylindrical and lower conical elements being held in a partially overlapping configuration by means of an inner spacer element and an outer supporting stand.

Alternatively, the monopole radiating element includes an upstanding multi-branched structure.

In accordance with another preferred embodiment of the present invention, the plurality of horizontally polarized radiating elements includes an array of horizontally polarized radiating elements.

Preferably, the array of horizontally polarized radiating elements includes an array of horizontally polarized dipoles.

Preferably, the array includes four dipoles arranged in a square-like configuration.

Alternatively, the array of horizontally polarized radiating elements includes an array of horizontally polarized loop radiating elements.

Preferably, the plurality of horizontally polarized radiating elements is perpendicular to the vertical axis.

In accordance with yet another preferred embodiment of the present invention, the monopole radiating element radiates a vertically polarized conical omnidirectional beam.

Preferably, the plurality of horizontally polarized radiating elements radiates a horizontally polarized conical omnidirectional beam.

Preferably, polarizations of the vertically and horizontally polarized beams are mutually orthogonal.

In accordance with a further preferred embodiment of the present invention, the reflector includes a ground plane.

Preferably, the reflector is planar.

Alternatively, the reflector is non-planar.

Preferably, the reflector has an inverted pyramidal configuration.

In accordance with yet a further preferred embodiment of the present invention, the feed arrangement includes a first port for feeding the monopole radiating element and a second port for feeding the plurality of horizontally polarized radiating elements.

Preferably, the first port is galvanically connected to the monopole radiating element.

Preferably, the second port is connected to a common feed network feeding the plurality of horizontally polarized radiating elements.

Preferably, the feed network includes microstrip lines.

Additionally or alternatively, the feed network includes coaxial cables.

Preferably, the feed network includes a multi-planar feed network.

Preferably, the plurality of horizontally polarized radiating elements includes a plurality of broadband horizontally polarized radiating elements.

In accordance with another preferred embodiment of the present invention, the antenna also includes a second plurality of horizontally polarized radiating elements arranged generally concentrically with respect to the monopole radiating element, each one of the horizontally polarized radiating elements having a projection in a third plane generally perpendicular to the vertical axis, the third plane being offset from the first and the second planes in a direction along the vertical axis.

Preferably, the antenna includes a multiband antenna.

Preferably, the second plurality of horizontally polarized radiating elements includes an array of horizontally polarized radiating elements. \

Preferably, the horizontally polarized radiating elements include dipoles.

Preferably, the second plurality of horizontally polarized radiating elements is perpendicular to the vertical axis.

BRIEF DESCRIPTION OF THE DRAWINGS

The present invention will be understood and appreciated more fully from the following detailed description, taken in conjunction with the drawings in which:

FIGS. 9A, 9B and 9C are simplified graphs respectively showing an azimuth cut and two elevation cuts of radiation patterns of a vertically polarized radiating element in an antenna of the type illustrated in FIGS. 1-2C;

DETAILED DESCRIPTION OF PREFERRED EMBODIMENTS

Figure 1:
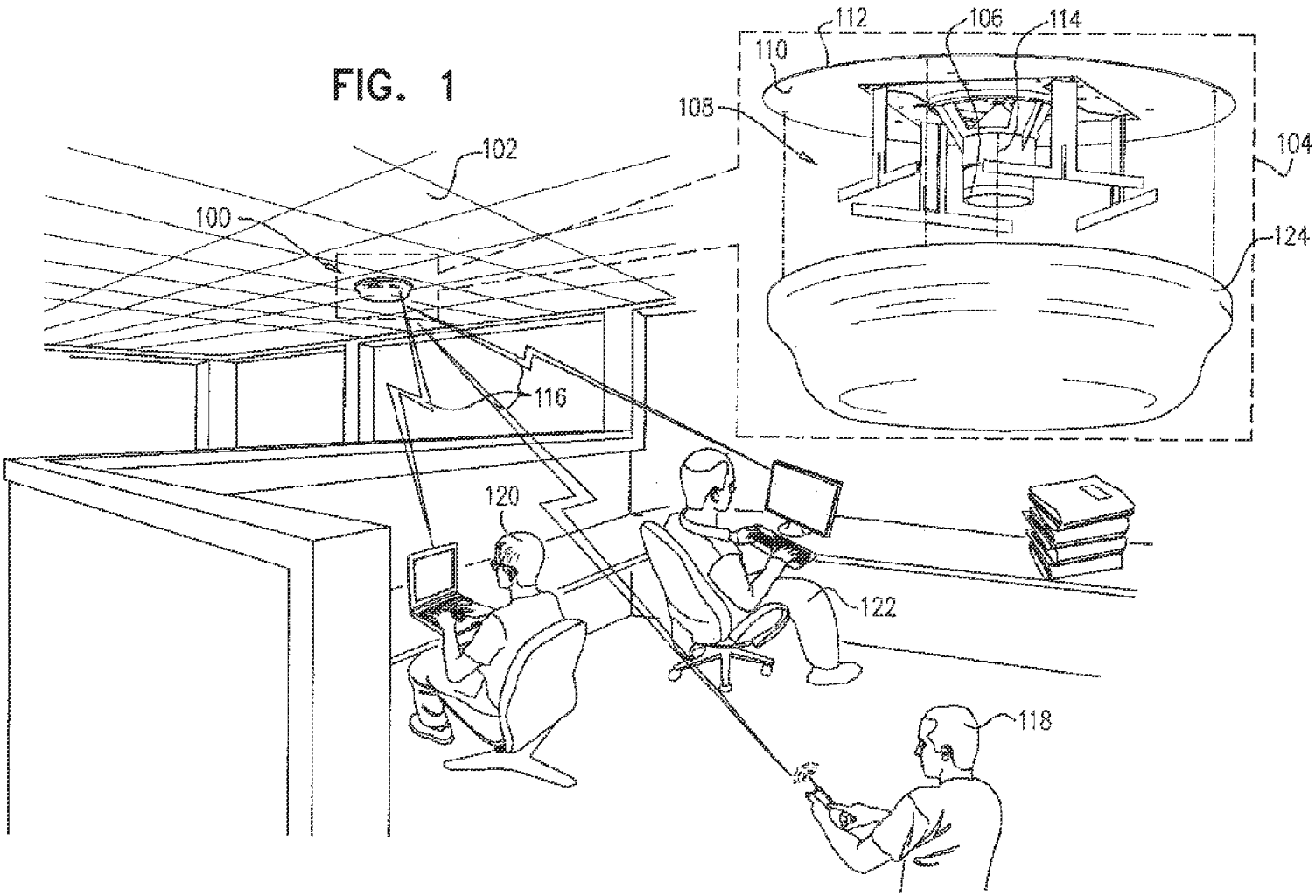
FIG. 1 is a schematic illustration of an antenna constructed and operative in accordance with a preferred embodiment of the present invention.

Reference is now made to FIG. 1, which is a schematic illustration of an antenna constructed and operative in accordance with a preferred embodiment of the present invention.

As seen in FIG. 1, there is provided an antenna 100. Antenna 100 is preferably an indoor-type antenna and is particularly preferably adapted for mounting on a ceiling 102. However, it is appreciated that antenna 100 may alternatively be adapted for mounting on a variety of indoor and/or outdoor surfaces, depending on the operating requirements of antenna 100.

As best seen at enlargement 104, antenna 100 includes a broadband vertically polarized monopole radiating element, here embodied, by way of example, as a broadband vertically polarized conical monopole radiating element 106. A plurality of horizontally polarized radiating elements, here embodied, by way of example, as an array of four horizontally polarized dipoles 108, is arranged generally concentrically with respect to monopole 106.

It is appreciated that antenna 100 thus constitutes a dual-polarized antenna, capable of simultaneously radiating vertically and horizontally polarized radio-frequency (RF) signals, by way of the simultaneous respective operation of the vertically polarized monopole 106 and the array of horizontally polarized dipoles 108. Due to their mutually orthogonal polarizations, monopole 106 and array of dipoles 108 are decorrelated, making antenna 100 particularly well suited for MIMO applications.

It is further appreciated that the structure and arrangement of monopole 106 and array of dipoles 108 are exemplary only and that a variety of other embodiments and arrangements of vertically polarized monopole radiating elements and horizontally polarized radiating elements are also possible, as will be exemplified henceforth.

Monopole 106 and array of dipoles 108 are preferably disposed on an upper surface 110 of a reflector 112, which reflector 112 preferably forms a ground plane of antenna 100. The presence of reflector 112 is a particular feature of a preferred embodiment of the present invention and creates several significant advantages in the operation of antenna 100.

The size, shape and location of reflector 112 serve to control the radiation patterns of both the monopole 106 and array of dipoles 108. In a particularly preferred embodiment of the present invention, the reflector 112 is arranged with respect to monopole 106 so as to have a projection in a first plane generally perpendicular to a vertical axis 114 of monopole 106. In the embodiment of the antenna illustrated in FIG. 1, by way of example, reflector 112 is shown to be a planar element defining a plane perpendicular to the vertical axis 114 of the monopole 106.

Array of dipoles 108 is preferably arranged such that each dipole has a projection in a second plane generally perpendicular to the vertical axis 114 of the monopole radiating element 106, the second plane being offset from the plane defined by the reflector 112 in a direction along the vertical axis 114 of monopole 106. In the embodiment of the antenna illustrated in FIG. 1, by way of example, the array of dipoles 108 is shown to comprise erect dipole structures disposed perpendicular to the vertical axis 114 of the monopole 106 and elevated with respect to the plane defined by reflector 112.

The above-described arrangement of reflector 112 with respect to monopole 106 and array of dipoles 108 leads to the formation of conical, omnidirectional radiation patterns by monopole 106 and array of dipoles 108. Such radiation patterns make antenna 100 particularly well suited for deployment as a ceiling-mount type antenna, as indicated by pictorially presented RF beams 116. Furthermore, as a result of monopole 106 and array of dipoles 108 having similar radiation patterns, antenna 100 provides well balanced horizontally and vertically polarized beam coverage over its operating environment.

In addition to influencing the radiation patterns of monopole 106 and array of dipoles 108, reflector 112 also serves to absorb stray RF radiation between monopole 106 and array of dipoles 108, thereby improving the isolation therebetween.

Furthermore, the presence of reflector 112 improves the isolation of monopole 106 and array of dipoles 108 from their surroundings and therefore reduces the susceptibility of antenna 100 to both physical and electrical external influences.

Due to the balanced, conical, omnidirectional and well-isolated beam patterns of monopole 106 and array of dipoles 108, antenna 100 may serve a multiplicity of users, such as users 118, 120 and 122, with high RF data throughput rates and minimal fading and scattering effects. Furthermore, since monopole 106 and array of dipoles 108 are mounted in close proximity to each other on a single platform formed by reflector 112, antenna 100 is extremely compact and relatively simple and inexpensive to manufacture in comparison to conventional MIMO antennas. The horizontal extent of antenna 100 is further advantageously reduced by the erect, rather than flat, arrangement of array of dipoles 108 with respect to reflector 112.

In operation of antenna 100, monopole 106 and array of dipoles 108 are fed by a feed arrangement. Preferably, monopole 106 receives a vertically polarized RF input signal at a first port (not shown) and array of dipoles 108 receives a horizontally polarized RF input signal at a second port (not shown). These first and second input ports are preferably located on an underside of reflector 112, opposite to surface 110 on which monopole 106 and array of dipoles 108 are preferably located. Further details of the feed arrangement via which monopole 106 and array of dipoles 108 are preferably fed are set forth below with references to FIGS. 2A-2C.

Antenna 100 may optionally be housed by a radome 124, which radome 124 preferably has both aesthetic and protective functions. Radome 124 may be formed of any suitable material that does not distort the preferred radiation patterns of antenna 100.

Figure 2A:
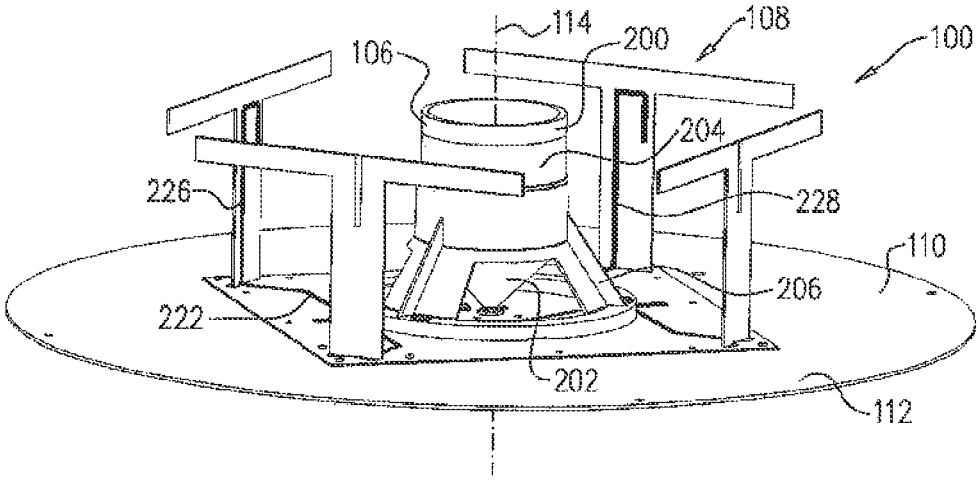
FIGS. 2A, 2B and 2C are simplified respective perspective, top and cross-sectional view illustrations of an antenna of the type illustrated in FIG. 1.
Figure 2B:
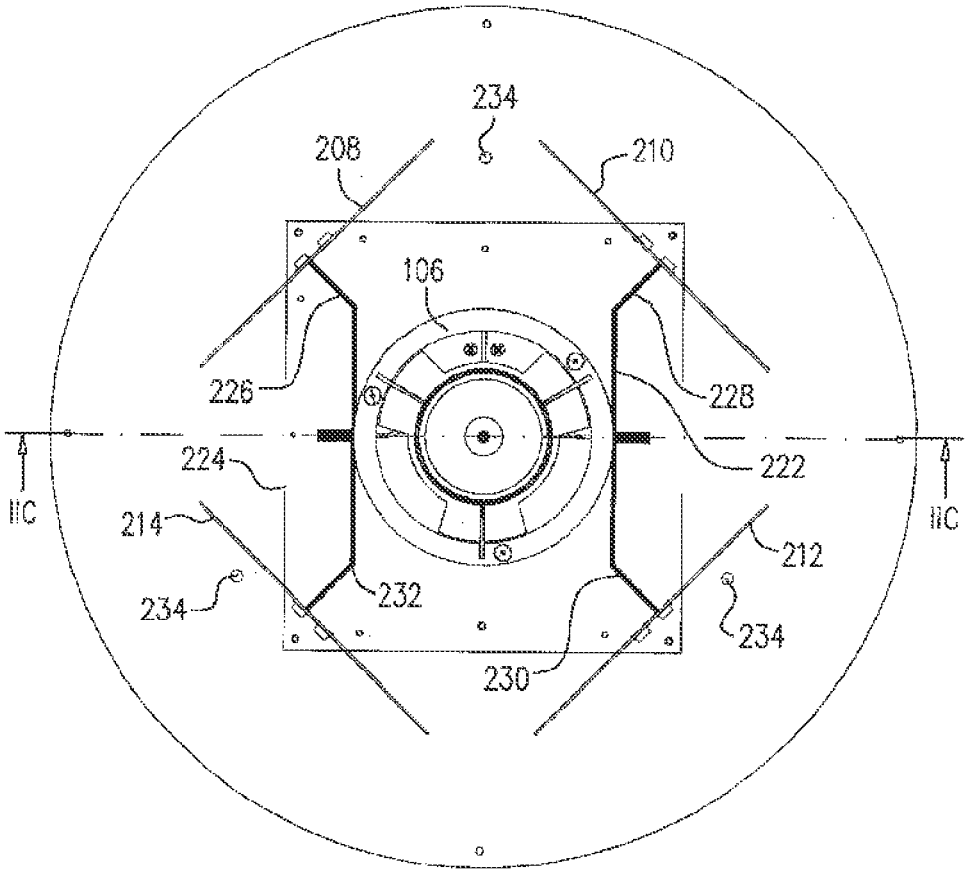
Figure 2C:
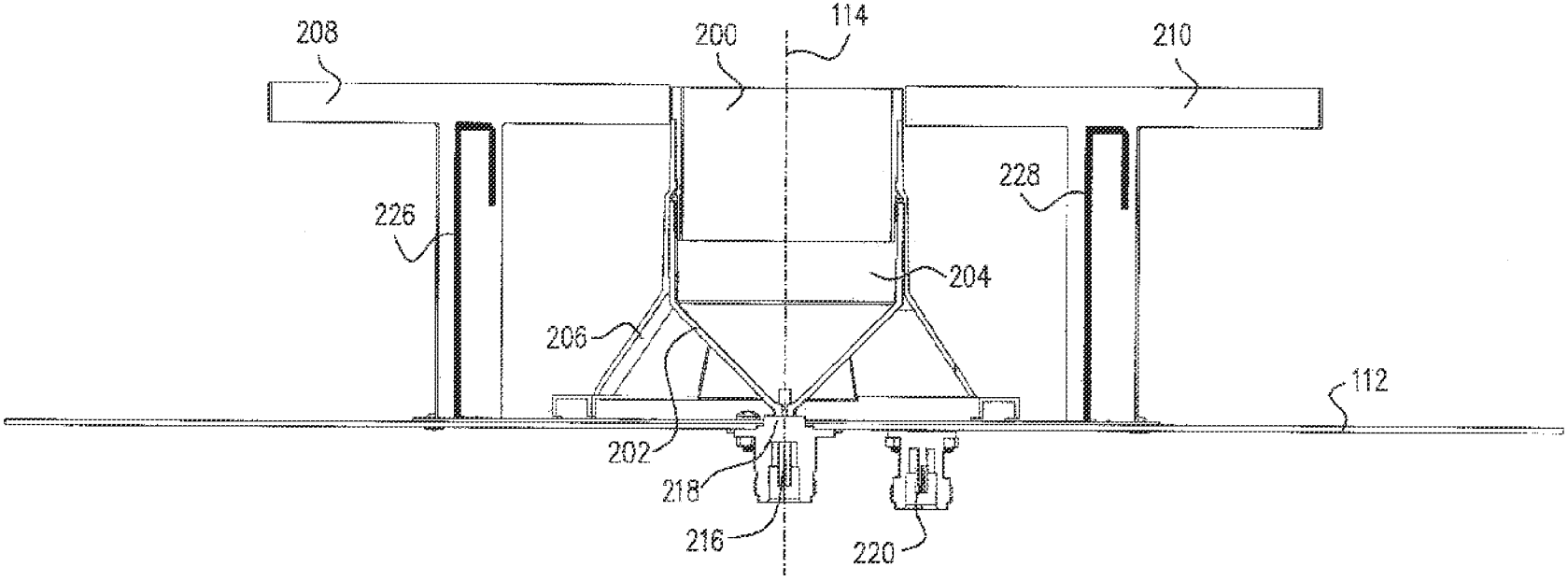

Reference is now made to FIGS. 2A, 2B and 2C, which are simplified respective perspective, top and cross-sectional view illustrations of an antenna of the type illustrated in FIG. 1.

As seen in FIGS. 2A-2C, antenna 100 includes vertically polarized conical monopole radiating element 106 surrounded concentrically by the array of horizontally polarized dipoles 108 and located on upper surface 110 of reflector 112. As seen most clearly in FIG. 2C, reflector 112 lies in first plane perpendicular to the vertical axis 114 of monopole 106.

Monopole 106 is preferably a broadband conical monopole, preferably comprising an upper conductive cylindrical element 200 and a lower conductive conical element 202. Cylindrical element 200 and conical element 202 are preferably held in a partially overlapping configuration by means of an inner dielectric spacer element 204 and outer supporting dielectric stand 206, as seen most clearly in FIG. 2C. It is appreciated, however, that the illustrated embodiment of monopole 106 is exemplary only and that a variety of other broadband monopole radiating elements are possible and are included in the scope of the present invention.

The array of dipoles 108 preferably comprises four dipoles 208, 210, 212 and 214, arranged in a square-like configuration surrounding monopole 106, as seen most clearly in FIG. 2B. It is appreciated, however, that other generally concentric arrangements of array of dipoles 108 with respect to monopole 106 are alternatively possible. As seen most clearly in FIG. 2C, each one of respective dipoles 208, 210, 212 and 214 lies in a second plane perpendicular to the vertical axis 114 of monopole 106 and elevated with respect to the first plane defined by reflector 112 in a direction along vertical axis 114.

In operation of antenna 100, monopole 106 preferably receives a vertically polarized RF input signal by way of a first feed port 216, which first port 216 is preferably galvanically connected to conical element 202 by means of an aperture 218 formed in reflector 112, as seen most clearly in FIG. 2C.

Array of dipoles 108 preferably receives a horizontally polarized RF input signal by way of a second feed port 220. In accordance with a particularly preferred embodiment of the present invention, the horizontally polarized RF signal received at second feed port 220 is delivered to each one of respective dipoles 208, 210, 212 and 214 via a common feed network 222, which common feed network 222 is preferably formed on a dielectric substrate 224. Thus, as seen most clearly in FIG. 2B, common feed network 222 preferably includes a first feed branch 226 exciting dipole 208, a second feed branch 228 exciting dipole 210, a third feed branch 230 exciting dipole 212 and a fourth feed branch 232 exciting dipole 214. Each of feed branches 226, 228, 230 and 232 of feed network 222 preferably terminates at the base of each corresponding dipole in an open-ended hook like structure visible in the cases of feed branches 226 and 228 in FIGS. 2A and 2C. It is appreciated that such a feed structure is exemplary only and that feed network 222 may terminate in other configurations adapted for feeding array of dipoles 108, as will be exemplified henceforth.

As seen most clearly in FIG. 2A, feed network 222 is a multi-planar feed network, preferably having portions lying both in the first plane defined by reflector 112 and perpendicular thereto. The multi-planar structure of feed network 222 is a particular feature of a preferred embodiment of the present invention and serves, among other features, to distinguish the antenna of the present invention over conventional MIMO antennas, which typically utilize planar feed networks. The multi-planar configuration of feed network 222 optimizes the isolation between monopole 106 and array of dipoles 108 by minimizing the interference that would be created therebetween by the presence of a feed network lying in the same plane as array of dipoles 108.

The feeding of individual respective dipoles 208, 210, 212 and 214 by means of a common feed network 222 is a further particular feature of a preferred embodiment of the present invention. The use of a common feed network endows the array of dipoles 108 with inherently broadband performance, as each one of respective dipoles 208, 210, 212 and 214 receives a co-phasic signal.

Feed network 222 is preferably formed of microstrip lines. Alternatively, feed network 222 may be formed of any suitable transmission lines known in the art including, for example, coaxial cables.

A multiplicity of holes 234 is optionally formed in reflector 212, in order to facilitate the attachment of reflector 212 to a supporting surface, such as ceiling 102 seen in FIG. 1. Holes 234 may also be used for the optional attachment of a radome to antenna 100, such as radome 124 illustrated in FIG. 1.

Figure 3A:
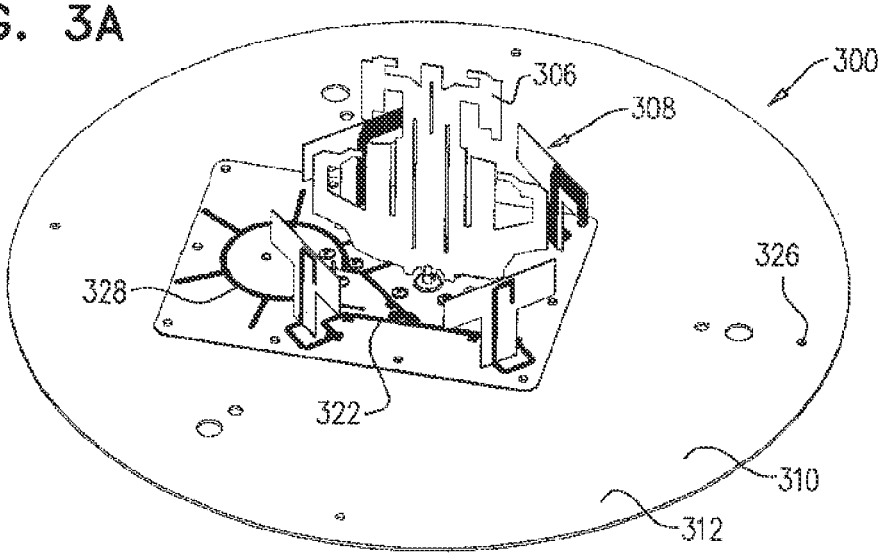
FIGS. 3A, 3B and 3C are simplified respective perspective, top and cross-sectional view illustrations of an antenna, constructed and operative in accordance with another preferred embodiment of the present invention.
Figure 3B:
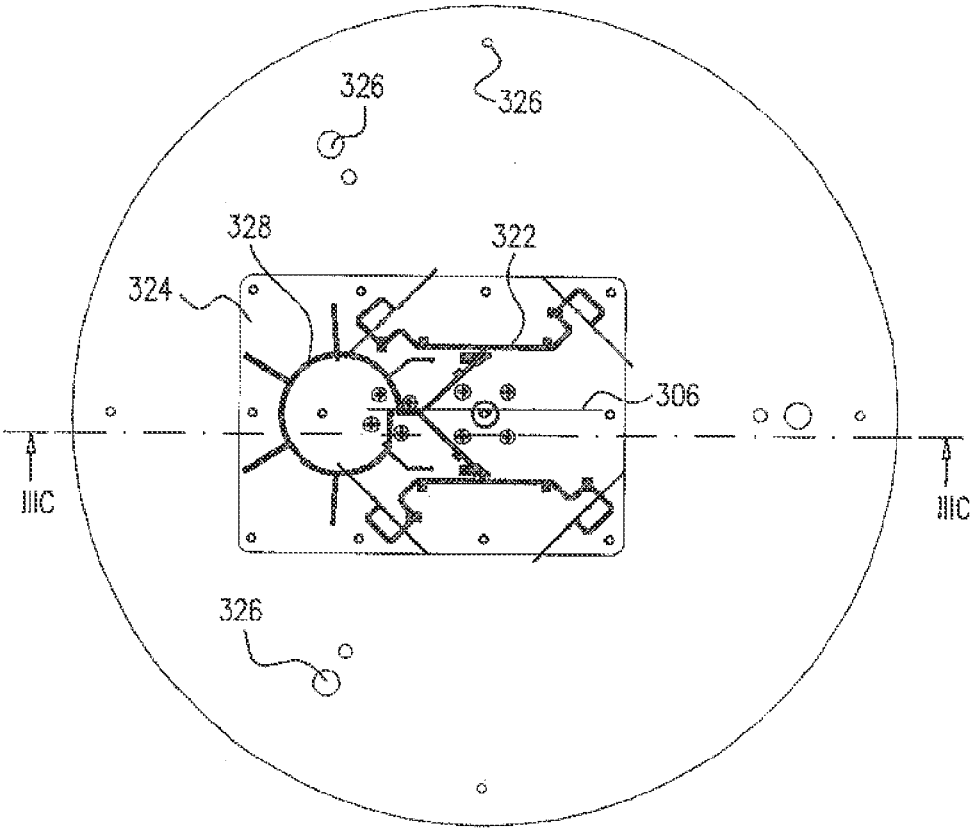
Figure 3C:
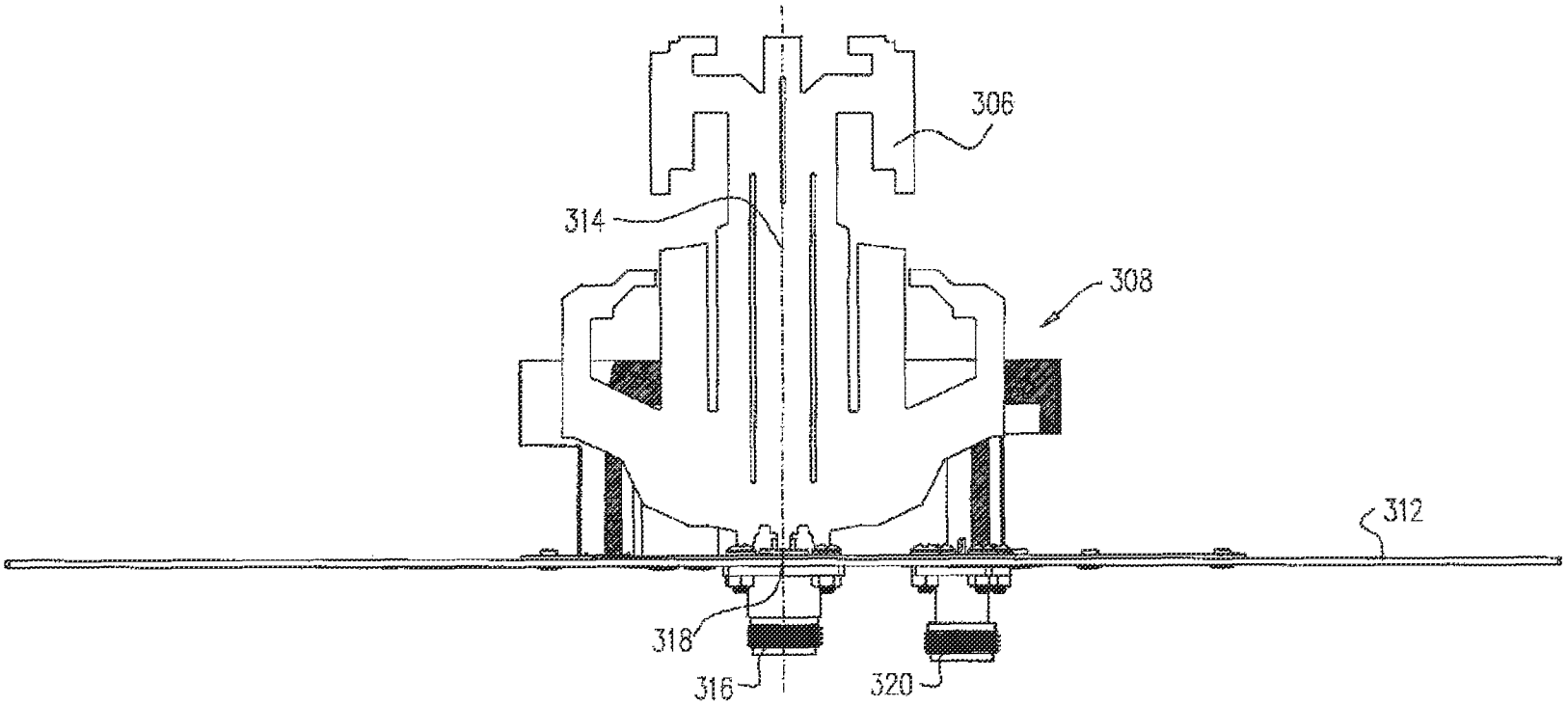

Reference is now made to FIGS. 3A-3C, which are simplified respective perspective, top and cross-sectional view illustrations of an antenna, constructed and operative in accordance with another preferred embodiment of the present invention.

As seen in FIGS. 3A-3C, there is provided an antenna 300. Antenna 300 includes a broadband vertically polarized monopole radiating element 306 and a plurality of horizontally polarized radiating elements, here embodied, by way of example, as an array of four horizontally polarized dipoles 308 arranged concentrically with respect to monopole 306. Monopole 306 and array of dipoles 308 are preferably located on an upper surface 310 of a reflector 312.

As seen most clearly in FIG. 3C, reflector 312 preferably has a projection in a first plane perpendicular to a vertical axis 314 of monopole 306 and each dipole of array of dipoles 308 preferably has a projection in a second plane perpendicular to the vertical axis 314, the second plane being elevated with respect to the first plane in a direction along the vertical axis 314.

Monopole 306 preferably receives a vertically polarized RF input signal at a first feed port 316, which first port 316 is preferably galvanically connected to the base of monopole 306 by way of an aperture 318 formed in reflector 312. Array of dipoles 308 preferably receives a horizontally polarized RF input signal at a second feed port 320, which RF signal is preferably delivered to each dipole of array of dipoles 308 via a common feed network 322, thereby endowing array of dipoles 308 with an inherently broadband performance. Feed network 322 is preferably formed on a surface of a dielectric substrate 324.

A multiplicity of holes 326 is optionally formed in reflector 312, in order to facilitate the attachment of reflector 312 to a supporting surface, such as a ceiling. Holes 326 may also be used for the optional attachment of a radome to antenna 300.

Antenna 300 also optionally includes a printed filter 328, which filter 328 is preferably printed on dielectric substrate 324. The use of a filter, such as filter 328, is well known in the art and serves to improve the isolation between monopole 306 and array of dipoles 308 by way of filtering unwanted frequencies of radiation passing therebetween.

It is appreciated that antenna 300 may resemble antenna 100 in every relevant respect with the exception of the structure of monopole 306. Whereas in antenna 100 monopole 106 is preferably embodied as a broadband conical monopole, in antenna 300 monopole 306 is preferably embodied as a broadband upstanding elaborately branched structure having an advantageously narrow footprint, as seen most clearly in FIG. 3B. It is appreciated that the conical and branched monopoles respectively illustrated in FIGS. 2A-2C and FIGS. 3A-3C are exemplary only and that a variety of other broadband vertically polarized monopole radiating elements are also possible.

Furthermore, antenna 300 may optionally differ from antenna 100 in the configuration of feed network 322. Whereas in antenna 100 the microstrip lines forming feed network 222 preferably terminate beneath each dipole in an open-ended hook-like configuration, in antenna 300 the microstrip lines forming feed network 322 preferably extend into each dipole, thereby directly feeding array of dipoles 308. It is appreciated, however, that the illustrated configuration of feed network 322 is exemplary only and that other feed arrangements known in the art are also possible.

Other features and advantages of antenna 300 are generally as described above in reference to antenna 100 and include its compact structure, multi-planar feed network and balanced, conical, omnidirectional and decorrelated vertically and horizontally polarized orthogonal radiation patterns.

Figure 4A:
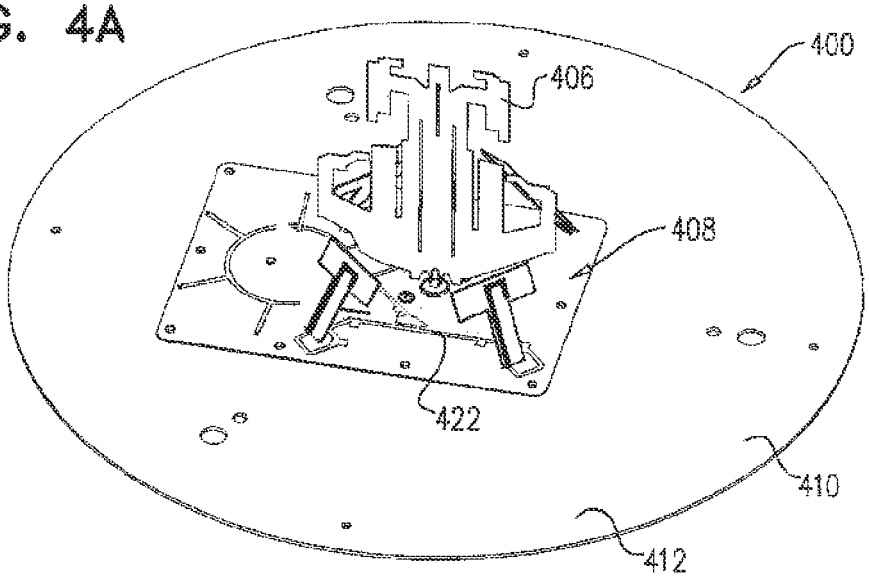
FIGS. 4A, 4B and 4C are simplified respective perspective, top and cross-sectional view illustrations of an antenna, constructed and operative in accordance with yet another preferred embodiment of the present invention.
Figure 4B:
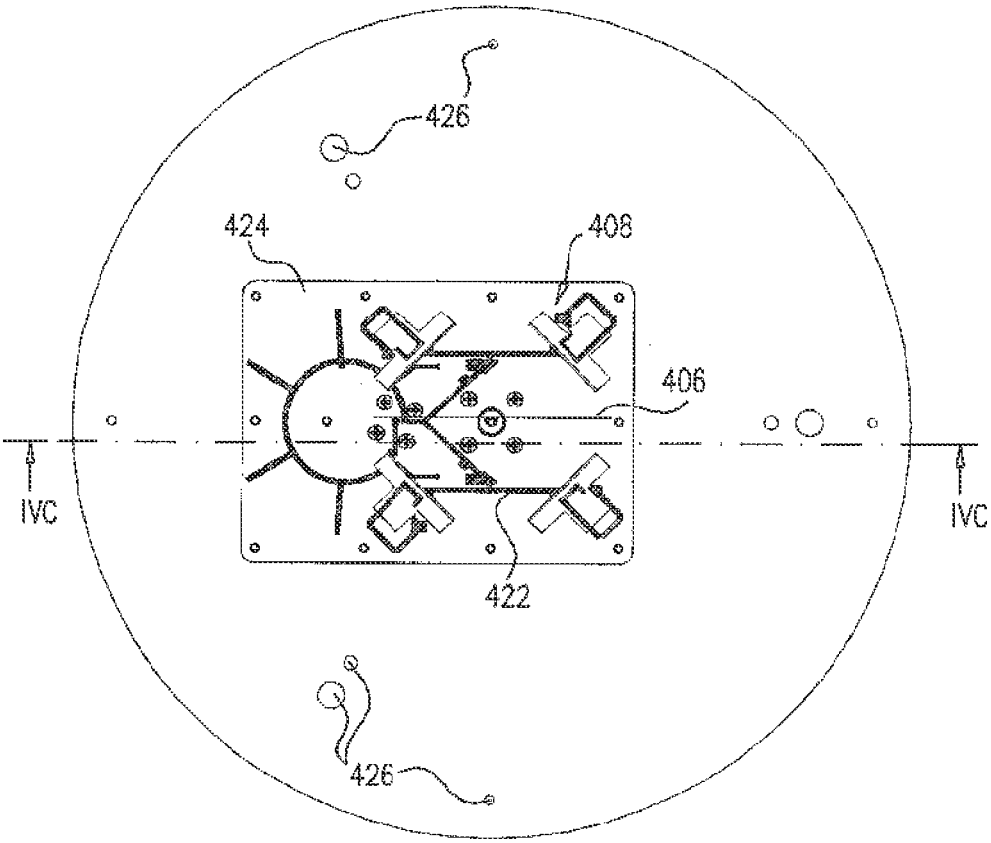
Figure 4C:
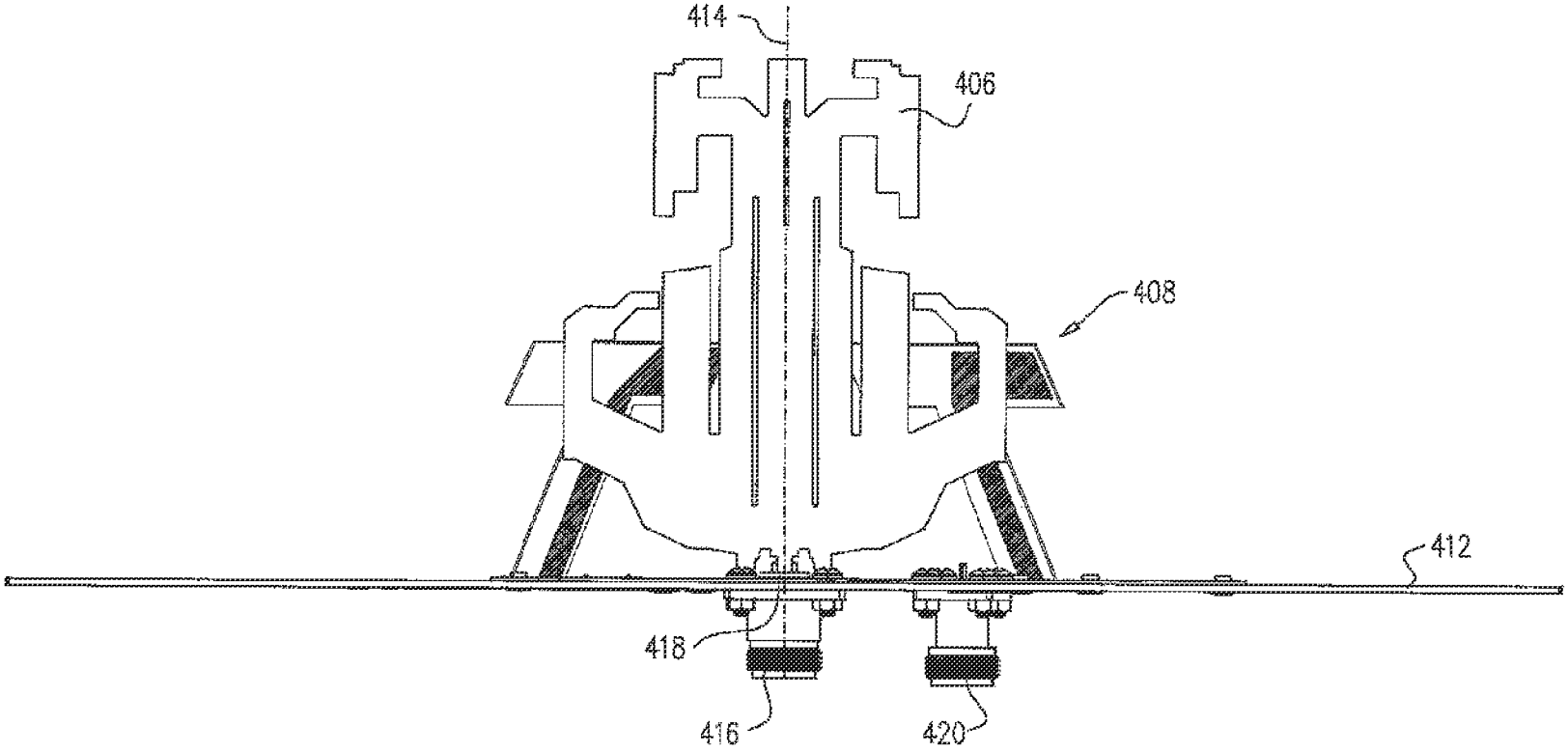

Reference is now made to FIGS. 4A-4C, which are simplified respective perspective, top and cross-sectional view illustrations of an antenna, constructed and operative in accordance with yet another preferred embodiment of the present invention.

As seen in FIGS. 4A-4C, there is provided an antenna 400. Antenna 400 includes a broadband vertically polarized branched monopole radiating element 406 and a plurality of horizontally polarized radiating elements, here embodied, by way of example, as an array of four horizontally polarized dipoles 408 arranged concentrically with respect to monopole 406. Monopole 406 and array of dipoles 408 are preferably located on an upper surface 410 of a reflector 412.

As seen most clearly in FIG. 4C, reflector 412 preferably has a projection in a first plane perpendicular to a vertical axis 414 of monopole 406 and each dipole of array of dipoles 408 preferably has a projection in a second plane perpendicular to the vertical axis 414, the second plane being elevated with respect to the first plane in a direction along the vertical axis 414.

Monopole 406 preferably receives a vertically polarized RF input signal at a first feed port 416, which first port 416 is preferably galvanically connected to the base of monopole 406 by way of an aperture 418 formed in reflector 412. Array of dipoles 408 preferably receives a horizontally polarized RF input signal at a second feed port 420, which RF signal is preferably delivered to each dipole of array of dipoles 408 via a common feed network 422, thereby endowing array of dipoles 408 with an inherently broadband performance. Feed network 422 is preferably formed on a surface of a dielectric substrate 424.

A multiplicity of holes 426 is optionally formed in reflector 412, in order to facilitate the attachment of reflector 412 to a supporting surface, such as a ceiling. Holes 426 may also be used for the optional attachment of a radome to antenna 400.

It is appreciated that antenna 400 may resemble antenna 300 in every relevant respect with the exception of the orientation of array of dipoles 408. Whereas in antenna 300, each dipole of array of dipoles 308 has a straight, upstanding orientation, whereby each dipole lies in a plane perpendicular to the vertical axis 314 of monopole 306, in antenna 400, each dipole of array of dipoles 408 has a tilted orientation. Each dipole of array of dipoles 408 thus has a projection in a plane perpendicular to the vertical axis 414 of monopole 406, as seen most clearly in FIG. 4C.

It is appreciated that the straight and tilted orientations of respective arrays of dipoles 300 and 400 is exemplary only and that other orientations of horizontally polarized radiating elements are also possible, provided that each horizontally polarized radiating element has a projection in a plane perpendicular to a vertical axis of the monopole radiating element.

Other features and advantages of antenna 400 are generally as described above in reference to antenna 300 and include its compact structure, multi-planar feed network and balanced, conical, omnidirectional and decorrelated vertically and horizontally polarized orthogonal radiation patterns.

Figure 5A:
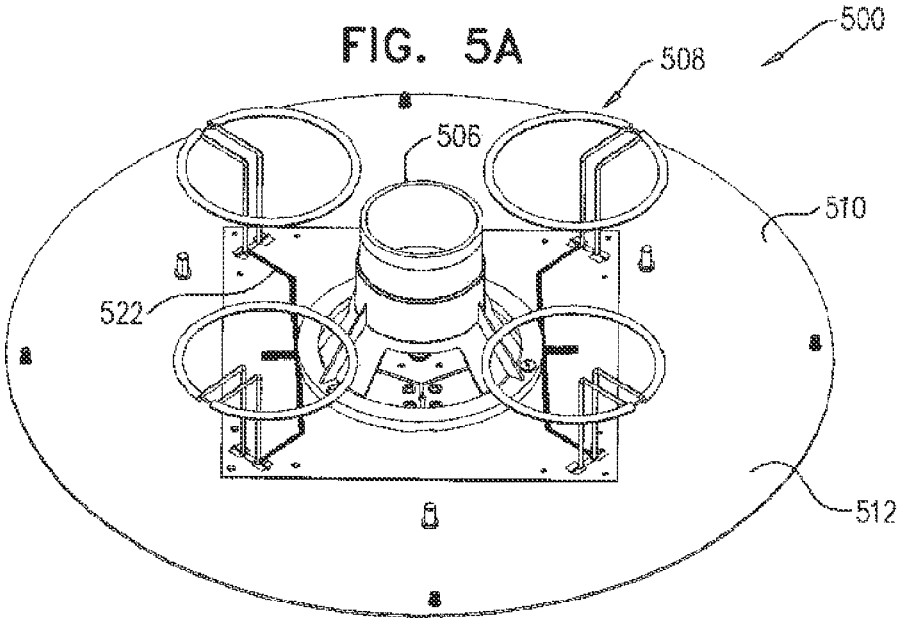
FIGS. 5A, 5B and 5C are simplified respective perspective, top and cross-sectional view illustrations of an antenna, constructed and operative in accordance with still another preferred embodiment of the present invention.
Figure 5B:
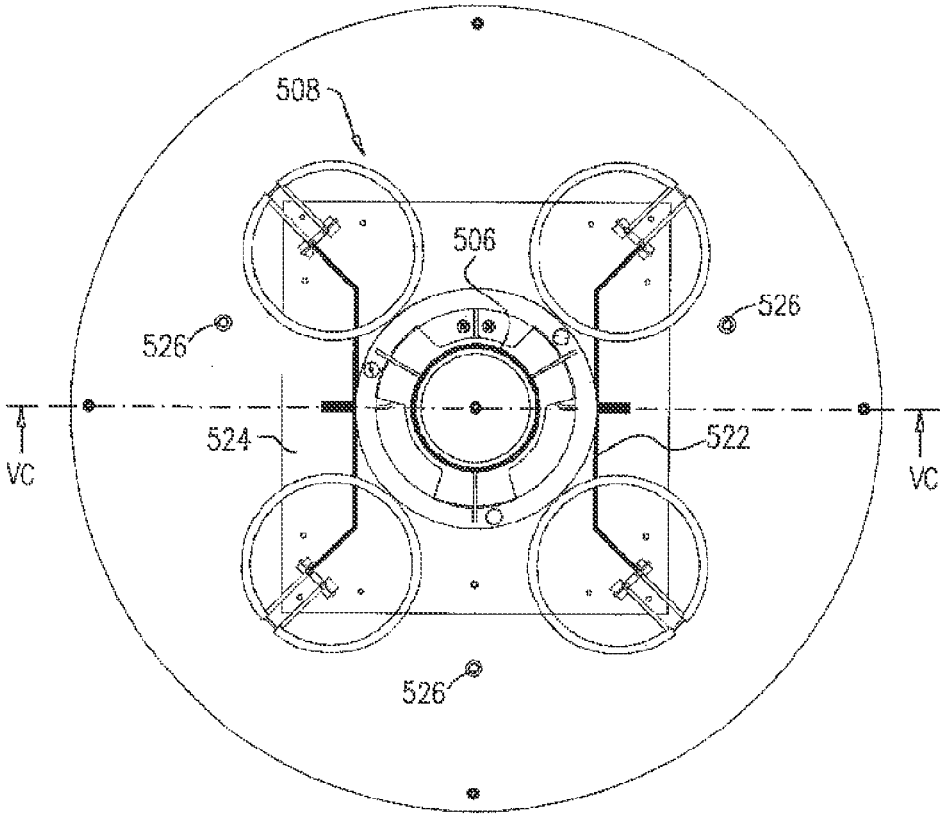
Figure 5C:
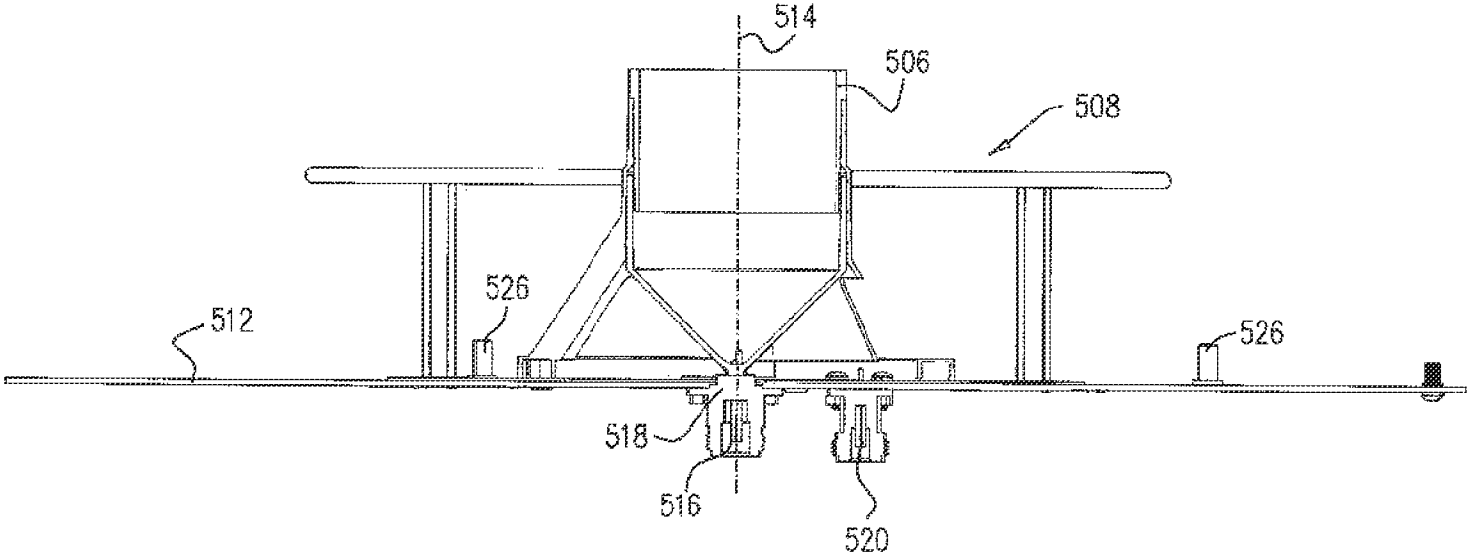

Reference is now made to FIGS. 5A-5C, which are simplified respective perspective, top and cross-sectional view illustrations of an antenna, constructed and operative in accordance with still another preferred embodiment of the present invention.

As seen in FIGS. 5A-5C, there is provided an antenna 500. Antenna 500 includes a broadband vertically polarized conical monopole radiating element 506 and a plurality of horizontally polarized radiating elements, here embodied, by way of example, as an array of four horizontally polarized loop radiating elements 508 preferably arranged concentrically with respect to monopole 506. Monopole 506 and array of loop radiating elements 508 are preferably located on an upper surface 510 of a reflector 512.

As seen most clearly in FIG. 5C, reflector 512 preferably has a projection in a first plane perpendicular to a vertical axis 514 of monopole 506 and each loop of the array of loop radiating elements 508 preferably has a projection in a second plane perpendicular to the vertical axis 514, the second plane being elevated with respect to the first plane in a direction along the vertical axis 514.

Monopole 506 preferably receives a vertically polarized RF input signal at a first feed port 516, which first port 516 is preferably galvanically connected to the base of monopole 506 by way of an aperture 518 formed in reflector 512. Array of loop radiating elements 508 preferably receives a horizontally polarized RF input signal at a second feed port 520, which RF signal is preferably delivered to each loop of array of loop radiating elements 508 via a common feed network 522, thereby endowing array of loop radiating elements 508 with an inherently broadband performance. Feed network 522 is preferably formed on a surface of a dielectric substrate 524.

A multiplicity of holes 526 is optionally formed in reflector 512, in order to facilitate the attachment of reflector 512 to a supporting surface, such as a ceiling. Holes 526 may also be used for the optional attachment of a radome to antenna 500.

It is appreciated that antenna 500 may resemble antenna 100 in every relevant respect with the exception of the structure of the horizontally polarized radiating elements. Whereas in antenna 100 the horizontally polarized radiating elements are preferably embodied as a plurality of horizontally polarized dipole radiating elements 108, in antenna 500 the horizontally polarized radiating elements are preferably embodied as a plurality of horizontally polarized loop radiating elements 508.

It is appreciated that the dipole and loop radiating elements respectively illustrated in FIGS. 1-4C and FIGS. 5A-5C are exemplary only and that a variety of other horizontally polarized radiating elements are also possible and are included in the scope of the present invention.

Other features and advantages of antenna 500 are generally as described above in reference to antenna 100 and include its compact structure, multi-planar feed network and balanced, conical, omnidirectional and decorrelated vertically and horizontally polarized orthogonal radiation patterns.

Figure 6A:
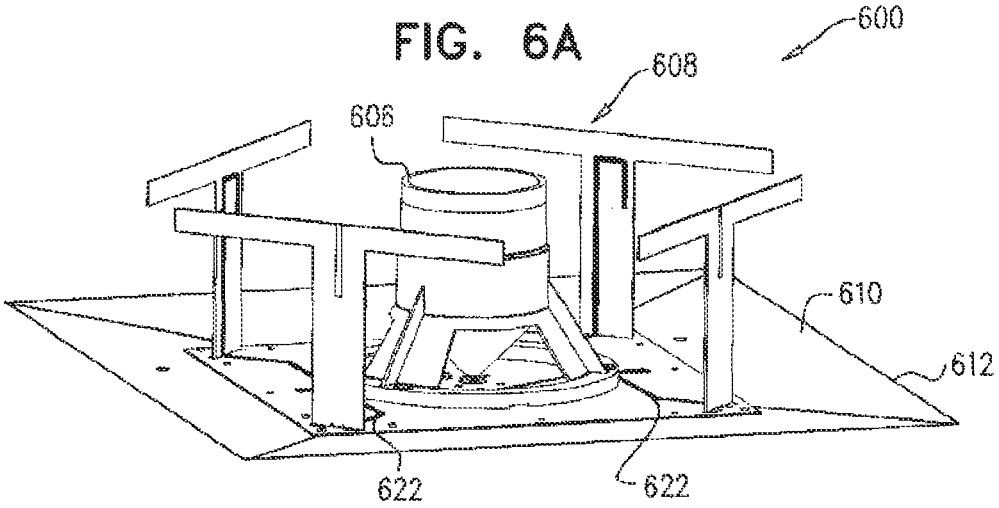
FIGS. 6A, 6B and 6C are simplified respective perspective, top and cross-sectional view illustrations of an antenna, constructed and operative in accordance with a further preferred embodiment of the present invention.
Figure 6B:
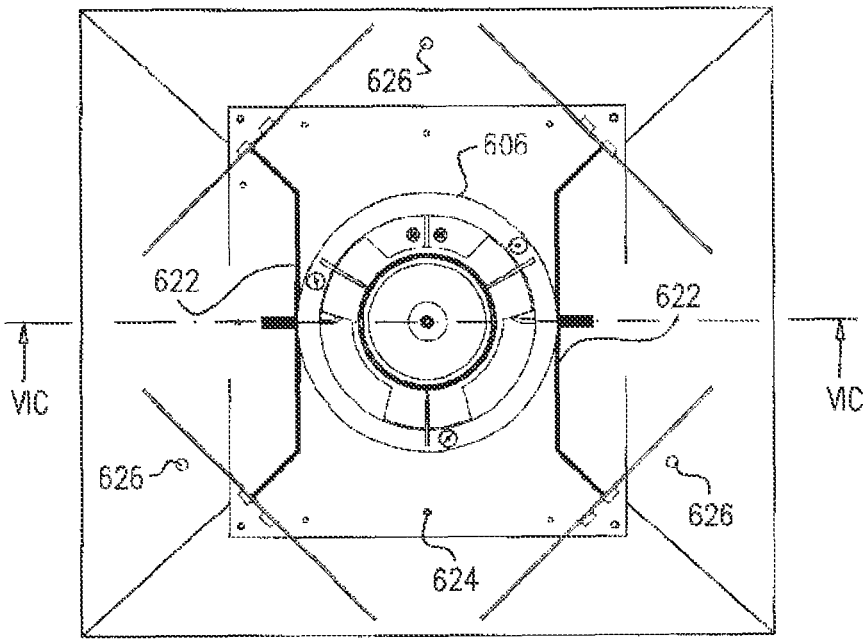
Figure 6C:
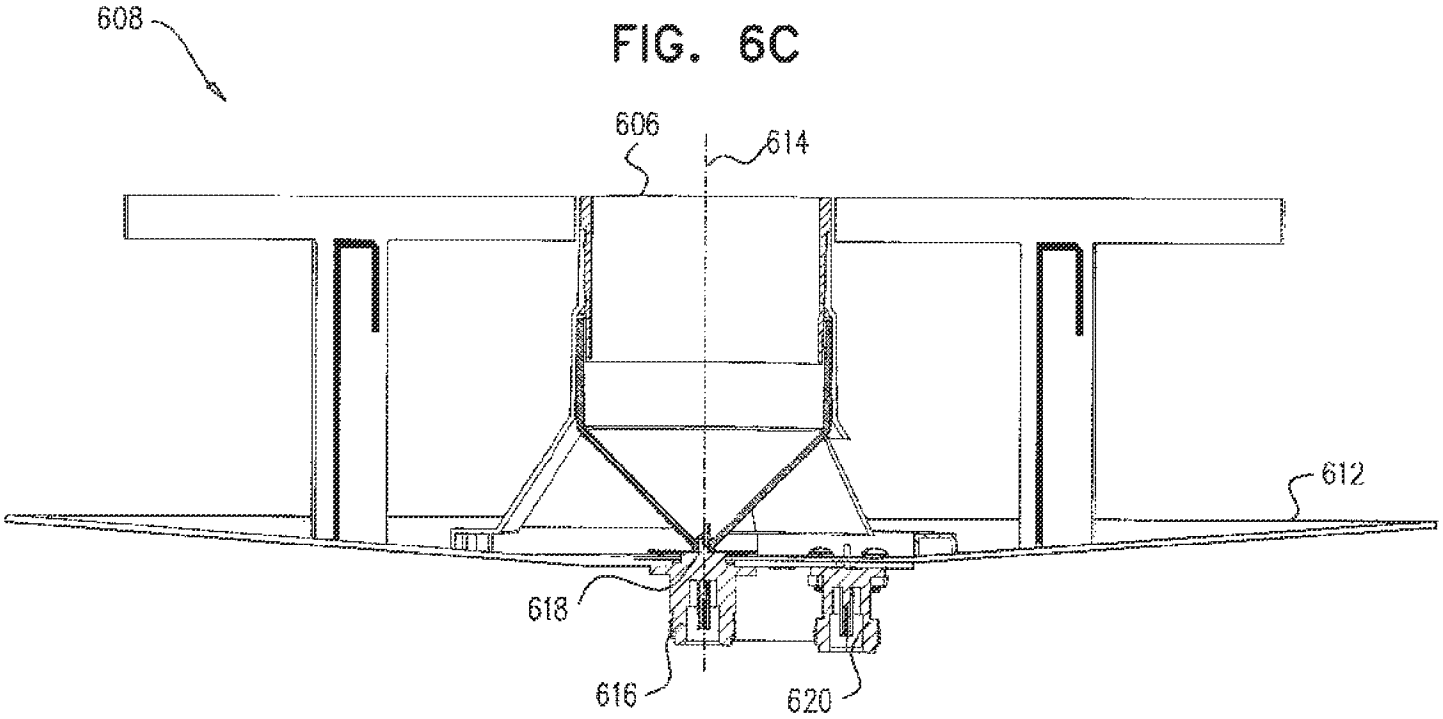

Reference is now made to FIGS. 6A-6C, which are simplified respective perspective, top and cross-sectional view illustrations of an antenna, constructed and operative in accordance with a further preferred embodiment of the present invention.

As seen in FIGS. 6A-6C, there is provided an antenna 600. Antenna 600 includes a broadband vertically polarized conical monopole radiating element 606 and a plurality of horizontally polarized radiating elements, here embodied, by way of example, as an array of four dipoles 608 arranged concentrically with respect to monopole 606. Monopole 606 and array of dipoles 608 are preferably located on an upper surface 610 of a reflector 612.

As seen most clearly in FIG. 6C, reflector 612 preferably has a projection in a first plane perpendicular to a vertical axis 614 of monopole 606 and each dipole of array of dipoles 608 preferably has a projection in a second plane perpendicular to the vertical axis 614, the second plane being elevated with respect to the first plane in a direction along the vertical axis 614.

Monopole 606 preferably receives a vertically polarized RF input signal at a first feed port 616, which first port 616 is preferably galvanically connected to the base of monopole 606 by way of an aperture 618 formed in reflector 612. Array of dipoles 608 preferably receives a horizontally polarized RF input signal at a second feed port 620, which RF signal is preferably delivered to each dipole of array of dipoles 608 via a common feed network 622, thereby endowing array of dipoles 608 with an inherently broadband performance. Feed network 622 is preferably formed on a surface of a dielectric substrate 624.

A multiplicity of holes 626 is optionally formed in reflector 612, in order to facilitate the attachment of reflector 612 to a supporting surface, such as a ceiling. Holes 626 may also be used for the optional attachment of a radome to antenna 600.

It is appreciated that antenna 600 may resemble antenna 100 in every relevant respect with the exception of the structure of the reflector 612. Whereas in antenna 100, reflector 112 is preferably embodied as a circular planar element, lying perpendicular to the vertical axis 114 of monopole 106, in antenna 600 reflector 612 is preferably embodied as a shallow inverted pyramidal element. Reflector 612 thus has a projection in a plane perpendicular to the vertical axis 614 of monopole 606, as seen most clearly in FIG. 6C.

It is appreciated that the shapes of the circular planar reflector and inverted pyramidal reflector respectively illustrated in FIGS. 1-5C and FIGS. 6A-6C are exemplary only and that a variety of other reflector configurations are possible, provided that the reflector has a projection in a plane perpendicular to a vertical axis of the monopole radiating element.

Other features and advantages of antenna 600 are generally as described above in reference to antenna 100 and include its compact structure, multi-planar feed network and balanced, conical, omnidirectional and decorrelated vertically and horizontally polarized orthogonal radiation patterns.

Figure 7A:
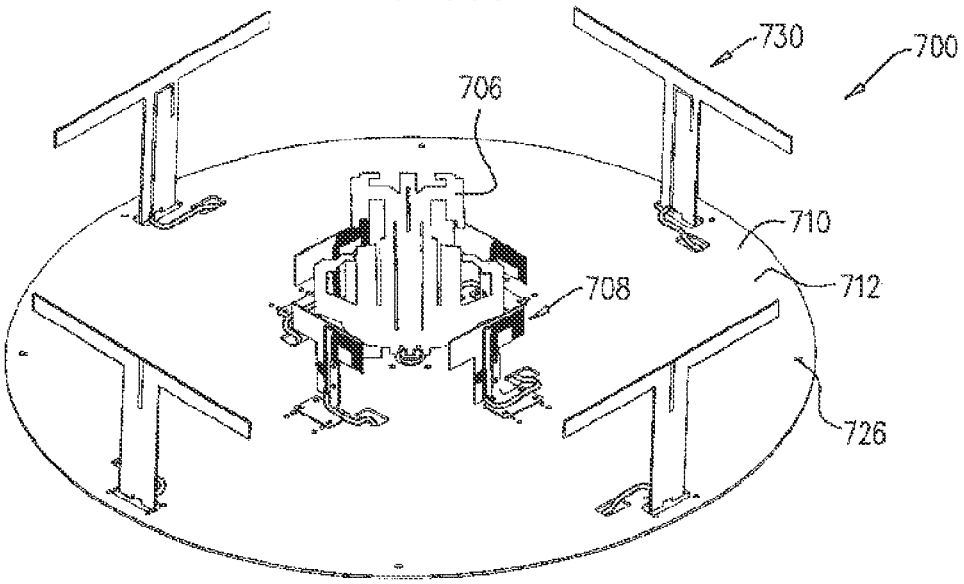
FIGS. 7A, 7B and 7C are simplified respective perspective, top and cross-sectional view illustrations of an antenna, constructed and operative in accordance with yet a further preferred embodiment of the present invention.
Figure 7B:
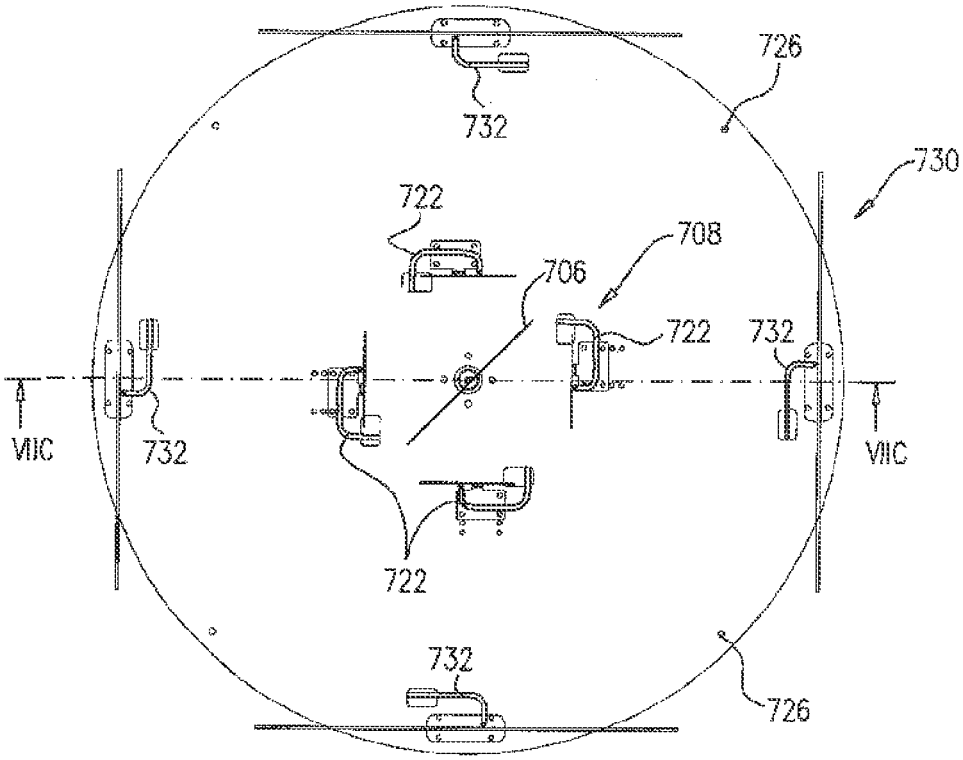
Figure 7C:
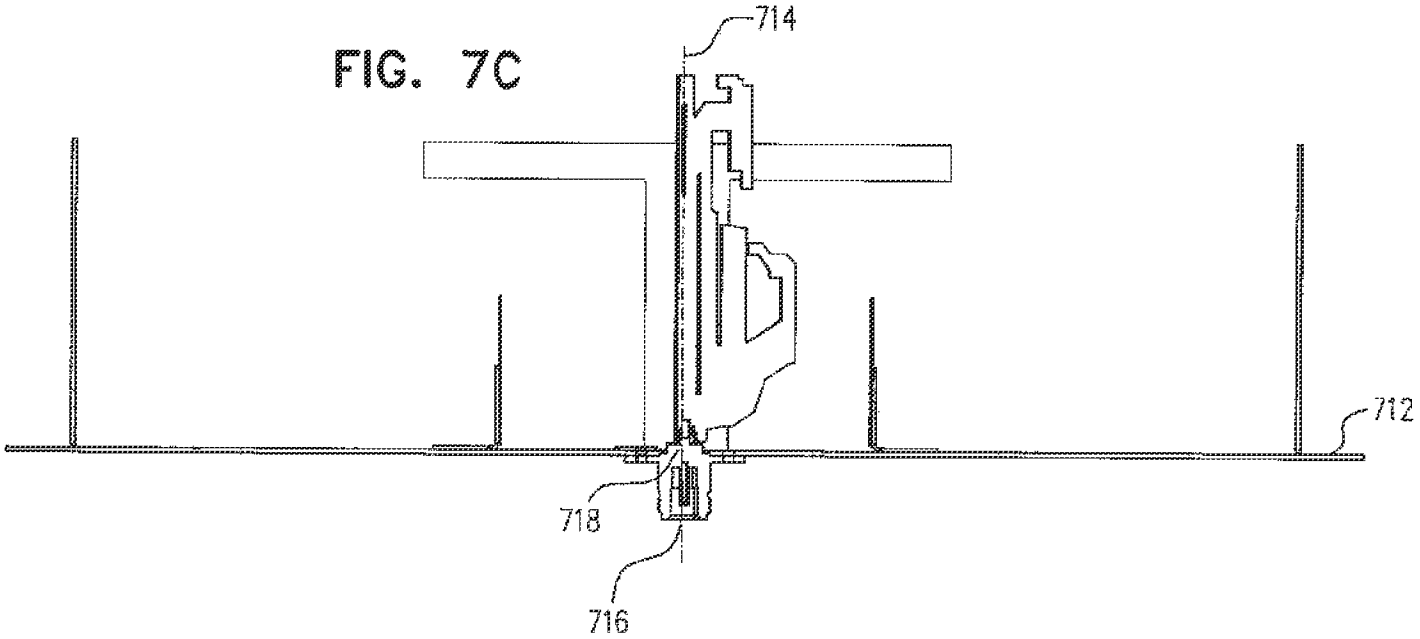

Reference is now made to FIGS. 7A-7C, which are simplified respective perspective, top and cross-sectional view illustrations of an antenna, constructed and operative in accordance with yet a further preferred embodiment of the present invention.

As seen in FIGS. 7A-7C, there is provided an antenna 700. Antenna 700 includes a broadband vertically polarized monopole radiating element 706 and a plurality of horizontally polarized radiating elements, here embodied, by way of example, as an array of four dipoles 708, arranged concentrically with respect to monopole 706. Monopole 706 and array of dipoles 708 are preferably located on an upper surface 710 of a reflector 712.

As seen most clearly in FIG. 7C, reflector 712 preferably has a projection in a first plane perpendicular to a vertical axis 714 of monopole 706 and each dipole of array of dipoles 708 preferably has a projection in a second plane perpendicular to the vertical axis 714, the second plane being elevated with respect to the first plane in a direction along the vertical axis 714.

Monopole 706 preferably receives a vertically polarized RF input signal at a first feed port 716, which first port 716 is preferably galvanically connected to the base of monopole 706 by way of an aperture 718 formed in reflector 712. Array of dipoles 708 preferably receives a horizontally polarized RF input signal at a second feed port (not shown), which RF signal is preferably delivered to each dipole of array of dipoles 708 via a common feed network 722, thereby endowing array of dipoles 708 with an inherently broadband performance. Feed network 722 preferably comprises coaxial cables and may optionally include a microstrip splitter, as is well known in the art.

A multiplicity of holes 726 is optionally formed in reflector 712, in order to facilitate the attachment of reflector 712 to a supporting surface, such as a ceiling. Holes 726 may also be used for the optional attachment of a radome to antenna 700.

It is appreciated that antenna 700 may resemble antenna 300 in every relevant respect, with the exception of the inclusion of an additional plurality of horizontally polarized radiating elements, preferably embodied as an outer array of horizontally polarized dipole radiating elements 730 in antenna 700. As is evident from a comparison of the inner array of dipoles 708 to the outer array of dipoles 730, inner array of dipoles 708 may generally resemble outer array of dipoles 730, with the exception of its dimensions. Outer array of dipoles 730 is preferably larger, both in its circumference and height, than inner array of dipoles 708, whereby outer array of dipoles 730 is preferably adapted to operate in a different frequency band than that of inner array of dipoles 708.

It is appreciated that antenna 700 thus constitutes a multiband antenna, capable of operating in two horizontally polarized frequency bands, respectively provided by inner array of dipoles 708 and outer array of dipoles 730. Outer array of dipoles 730 is preferably fed by a common feed network 732. Common feed network 732 preferably comprises coaxial cables and may optionally include a microstrip splitter, as is well known in the art. A filter may be optionally included in antenna 700 in order to enhance the electrical isolation between inner and outer dipole arrays 708 and 730.

As seen most clearly in FIG. 7C, each dipole of array of dipoles 730 preferably has a projection in a third plane perpendicular to the vertical axis 714, the third plane being offset from the first plane defined by reflector 712 and the second plane defined by array of dipoles 708.

It is appreciated that although in the illustrated embodiment of antenna 700 inner array of dipoles 708 and outer array of dipoles 730 are shown as comprising the same type of dipoles, inner array of dipoles 708 and outer array of dipoles 730 may alternatively comprise different types of dipoles. Furthermore, outer array of dipoles 730 may alternatively comprise horizontally polarized radiating elements other than dipoles, including, but not limited to, loop radiating elements.

Other features and advantages of antenna 700 are generally as described above in reference to antenna 300 and include its compact structure, multi-planar feed network and balanced, conical, omnidirectional and decorrelated vertically and horizontally polarized orthogonal radiation patterns. In addition, the structure of antenna 700 is particularly advantageous due to its multiband capability.

Figure 8A:
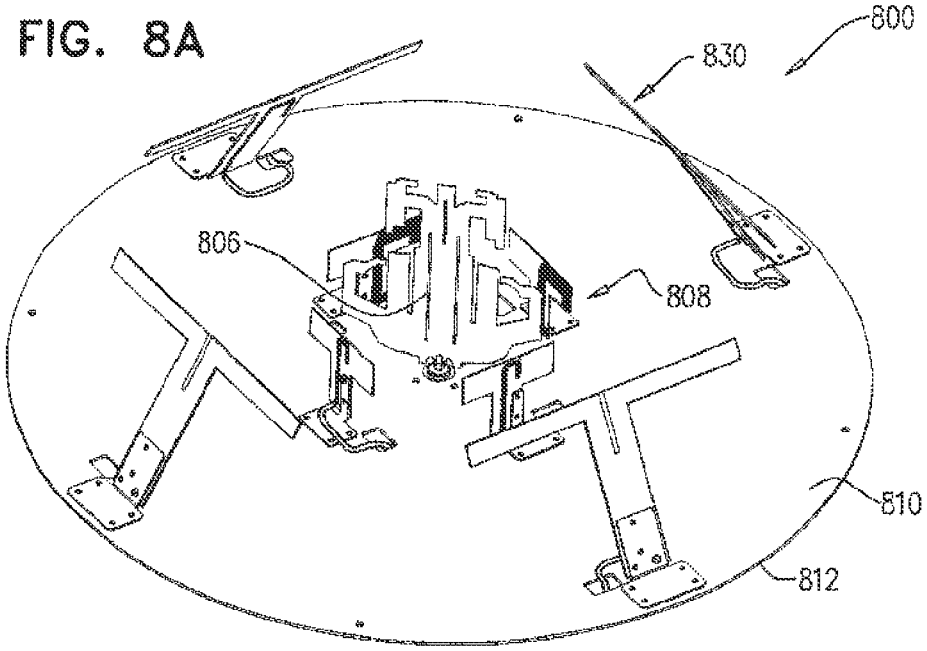
FIGS. 8A, 8B and 8C are simplified respective perspective, top and cross-sectional view illustrations of an antenna, constructed and operative in accordance with still a further preferred embodiment of the present invention.
Figure 8B:
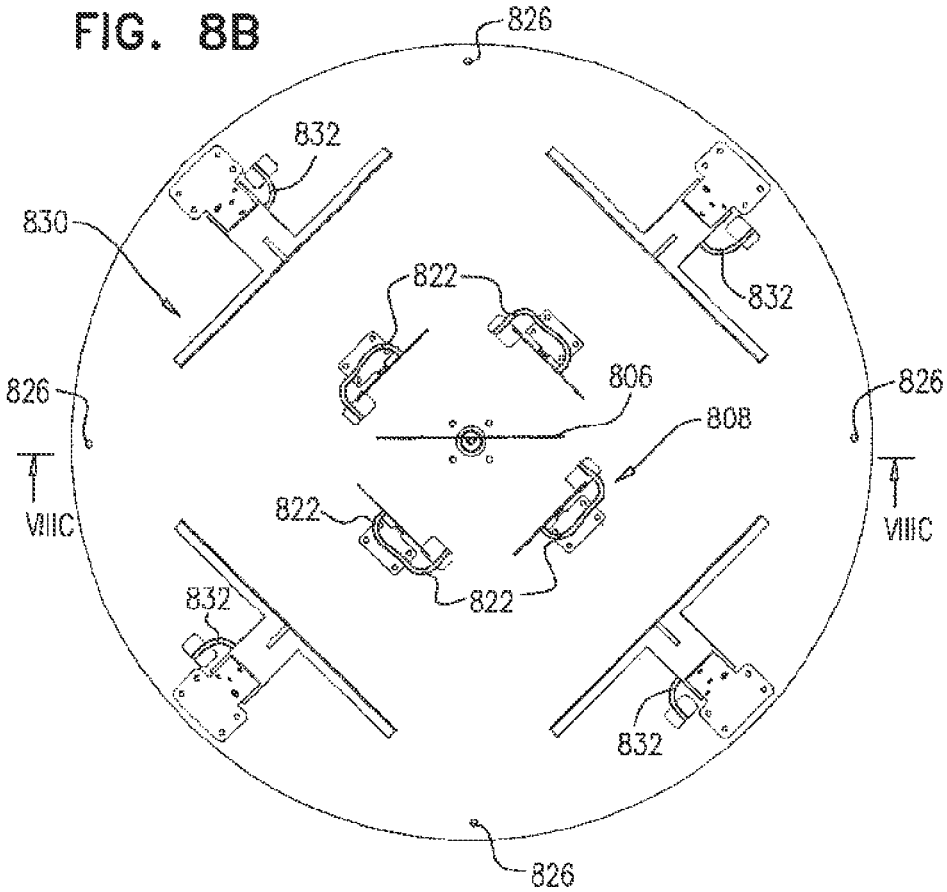
Figure 8C:
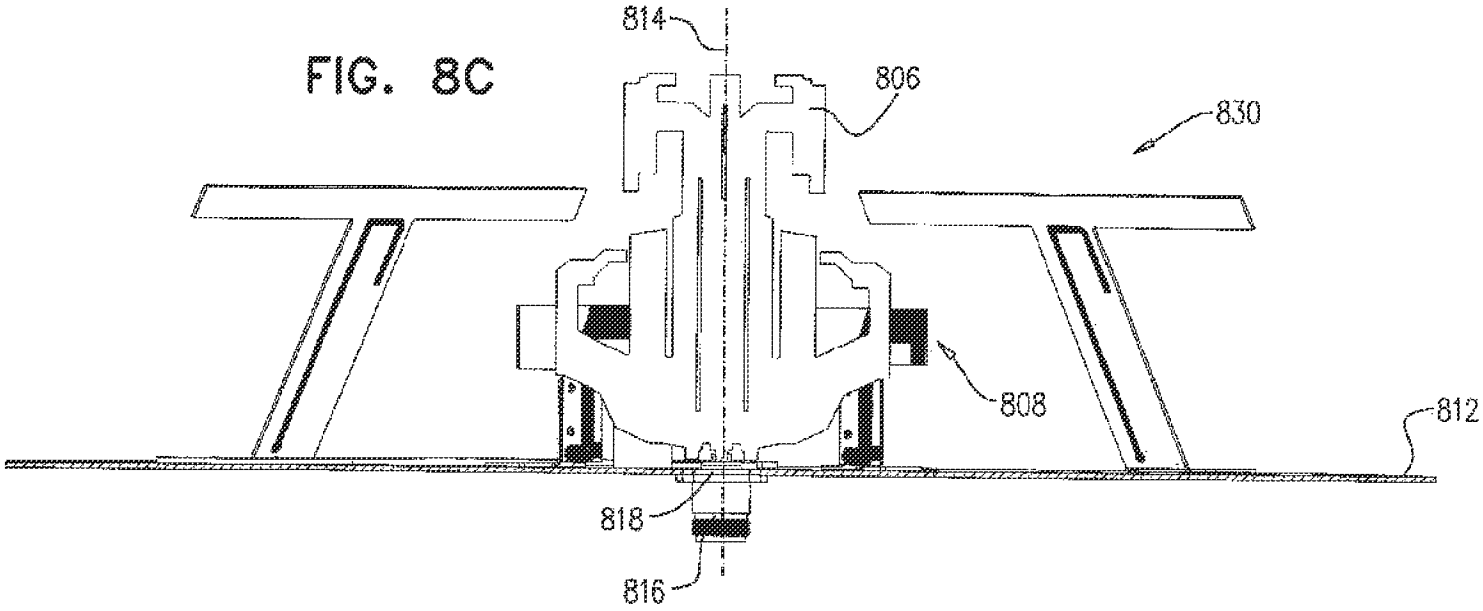

Reference is now made to FIGS. 8A-8C, which are simplified respective perspective, top and cross-sectional view illustrations of an antenna, constructed and operative in accordance with still a further preferred embodiment of the present invention.

As seen in FIGS. 8A-8C, there is provided an antenna 800. Antenna 800 includes a broadband vertically polarized monopole radiating element 806 and a plurality of horizontally polarized radiating elements, here embodied, by way of example, as an array of four horizontally polarized dipoles 808 arranged concentrically with respect to monopole 806. Monopole 806 and array of dipoles 808 are preferably located on an upper surface 810 of a reflector 812.

As seen most clearly in FIG. 8C, reflector 812 preferably has a projection in a first plane perpendicular to a vertical axis 814 of monopole 806 and each dipole of array of dipoles 808 preferably has a projection in a second plane perpendicular to the vertical axis 814, the second plane being elevated with respect to the first plane in a direction along the vertical axis 814.

Monopole 806 preferably receives a vertically polarized RF input signal at a first feed port 816, which first port 816 is preferably galvanically connected to the base of monopole 806 by way of an aperture 818 formed in reflector 812. Array of dipoles 808 preferably receives a horizontally polarized RF input signal at a second feed port (not shown), which RF signal is preferably delivered to each dipole of array of dipoles 808 via a common feed network 822, thereby endowing array of dipoles 808 with an inherently broadband performance. Feed network 822 preferably comprises coaxial cables and may optionally include a microstrip splitter, as is well known in the art.

A multiplicity of holes 826 is optionally formed in reflector 812, in order to facilitate the attachment of reflector 812 to a supporting surface, such as a ceiling. Holes 826 may also be used for the optional attachment of a radome to antenna 800.

Antenna 800 further includes an additional plurality of horizontally polarized radiating elements, here embodied, by way of example, as an outer array of horizontally polarized dipoles 830 arranged concentrically with respect to monopole 806 and inner array of dipoles 808. Inner array of dipoles 808 and outer array of dipoles 830 preferably respectively radiate in two different horizontally polarized frequency bands, thereby allowing antenna 800 to operate as a multiband antenna. Outer array of dipoles 830 is preferably fed by a common feed network 832. Feed network 832 preferably comprises coaxial cables and may optionally include a microstrip splitter as is well known in the art. A filter may be optionally included in antenna 800 in order to enhance the electrical isolation between inner and outer dipole arrays 808 and 830.

It is appreciated that antenna 800 may resemble antenna 700 in every relevant respect with the exception of the orientation of outer array of dipoles 830. Whereas in antenna 700, each dipole of outer array of dipoles 730 has a straight, upstanding orientation, whereby each dipole is perpendicular to the vertical axis 714 of monopole 706, in antenna 800, each dipole of outer array of dipoles 830 has a tilted orientation. Each dipole of outer array of dipoles 830 thus has a projection in a third plane perpendicular to the vertical axis 814 of monopole 806, the third plane being offset from both the first and second planes respectively defined by the reflector 812 and inner array of dipoles 808, as seen most clearly in FIG. 8C.

It is appreciated that the straight and tilted orientations of respective outer arrays of dipoles 730 and 830 is exemplary only and that other orientations of horizontally polarized radiating elements are also possible, provided that each horizontally polarized radiating element has a projection in a plane perpendicular to a vertical axis of the monopole radiating element.

Other features and advantages of antenna 800 are generally as described above in reference to antenna 700 and include its compact structure, multi-planar feed network and balanced, conical, omnidirectional and decorrelated vertically and multiband horizontally polarized orthogonal radiation patterns.

Experimental Results

In this section, experimental data generated for a dual-polarized antenna, constructed and operative in accordance with the embodiment of the invention illustrated in FIGS. 1-2C is presented. It is appreciated that the results obtained are representative of the performance of a dual-polarized antenna, constructed and operative in accordance with any of the embodiments of the present invention described above.

Details of Antenna Structure

The reflector comprised aluminum and had a diameter of 400 mm. Each lipole had a height of 150 mm and was separated from the monopole by a distance of 115 mm. The antenna was covered by a radome formed of PC/ABS and having a height of 110 mm.

The radiation patterns, return loss and isolation of the above-described antenna were measured in an antenna chamber, in accordance with methods well known in the art.

Radiation Patterns

Figure 9A:
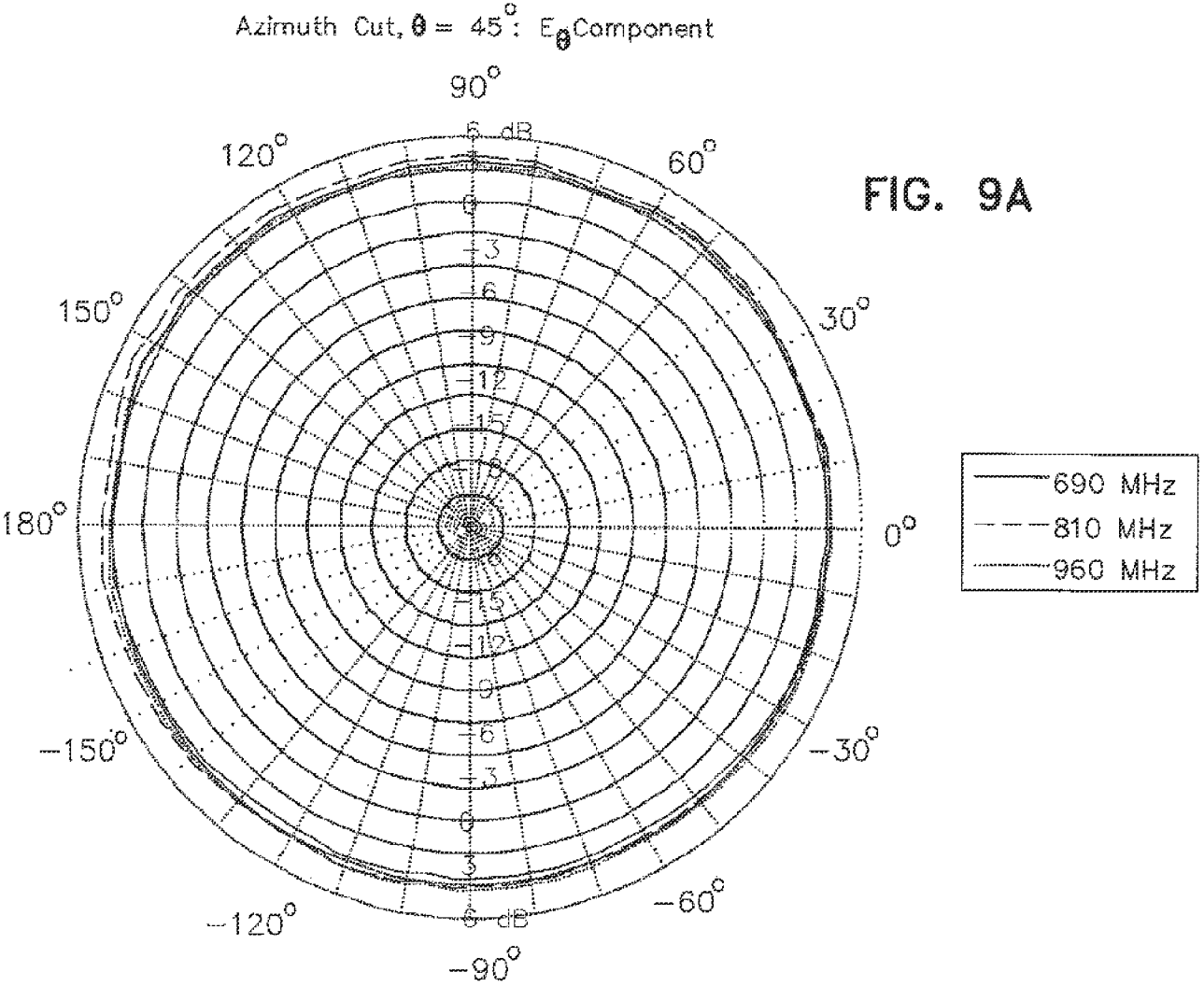
Figure 10A:
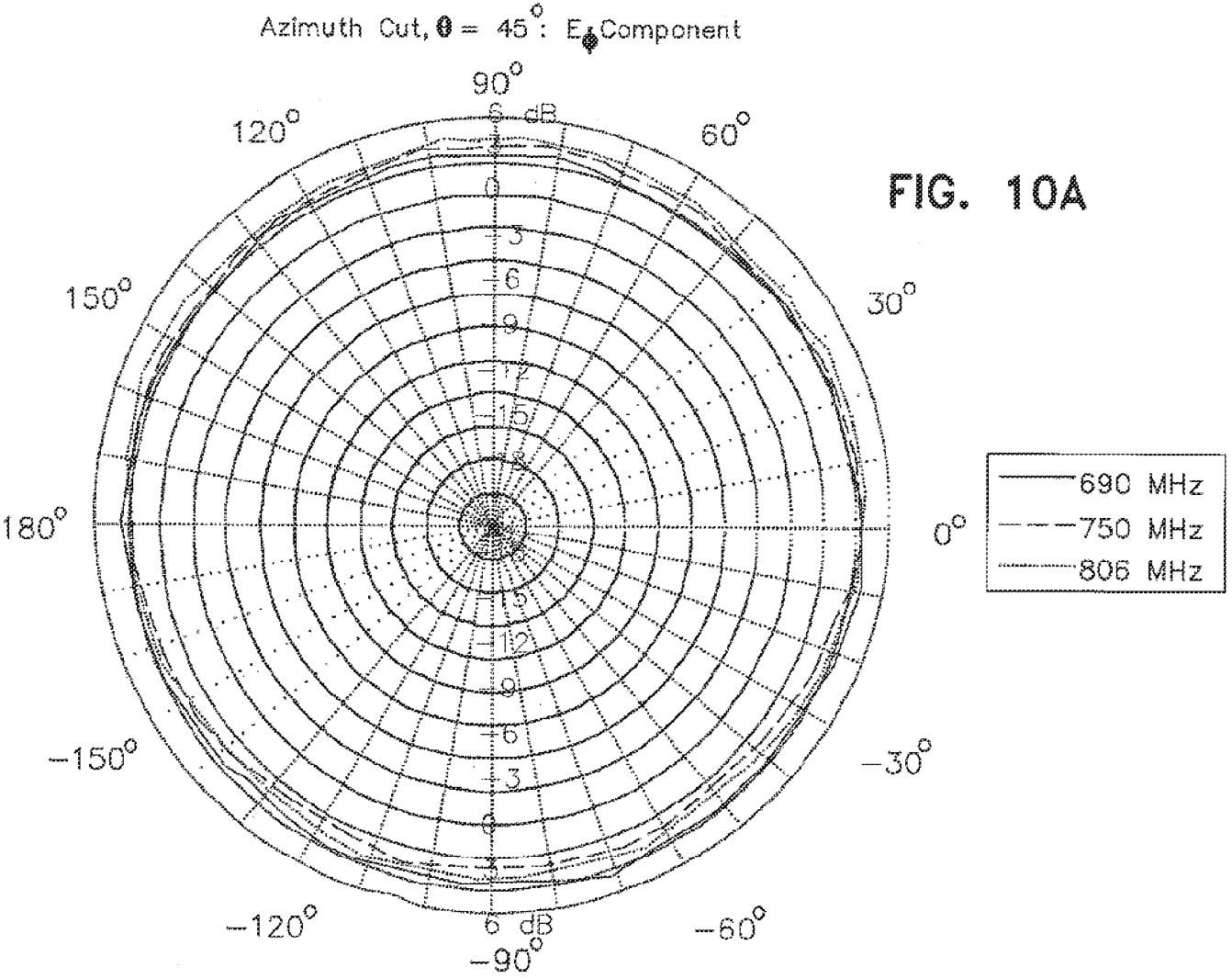
FIGS. 10A, 10B and 10C are simplified graphs respectively showing an azimuth cut and two elevation cuts of radiation patterns of horizontally polarized radiating elements in an antenna of the type illustrated in FIGS. 1-2C.
Figure 10B:
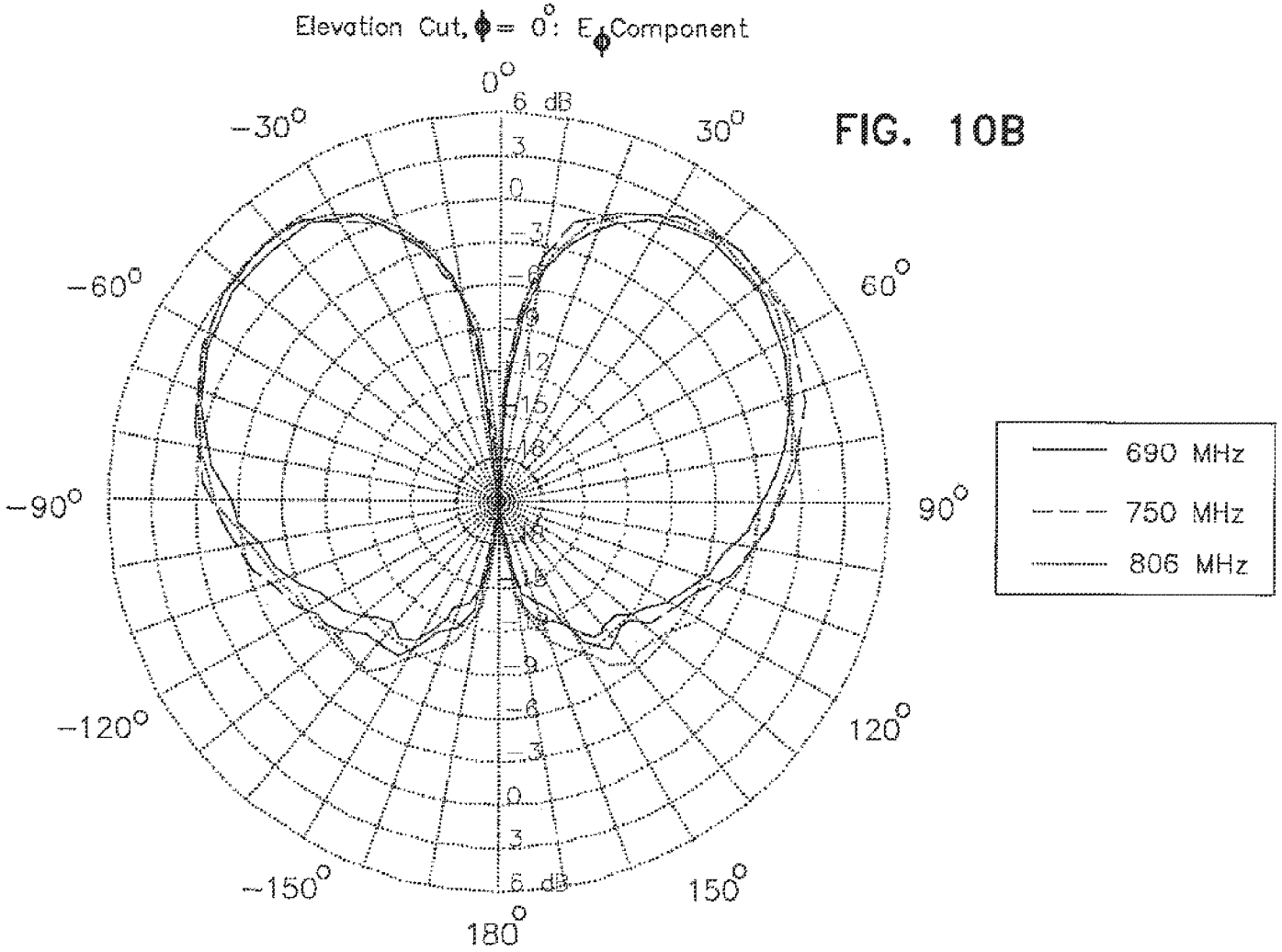
Figure 10C:
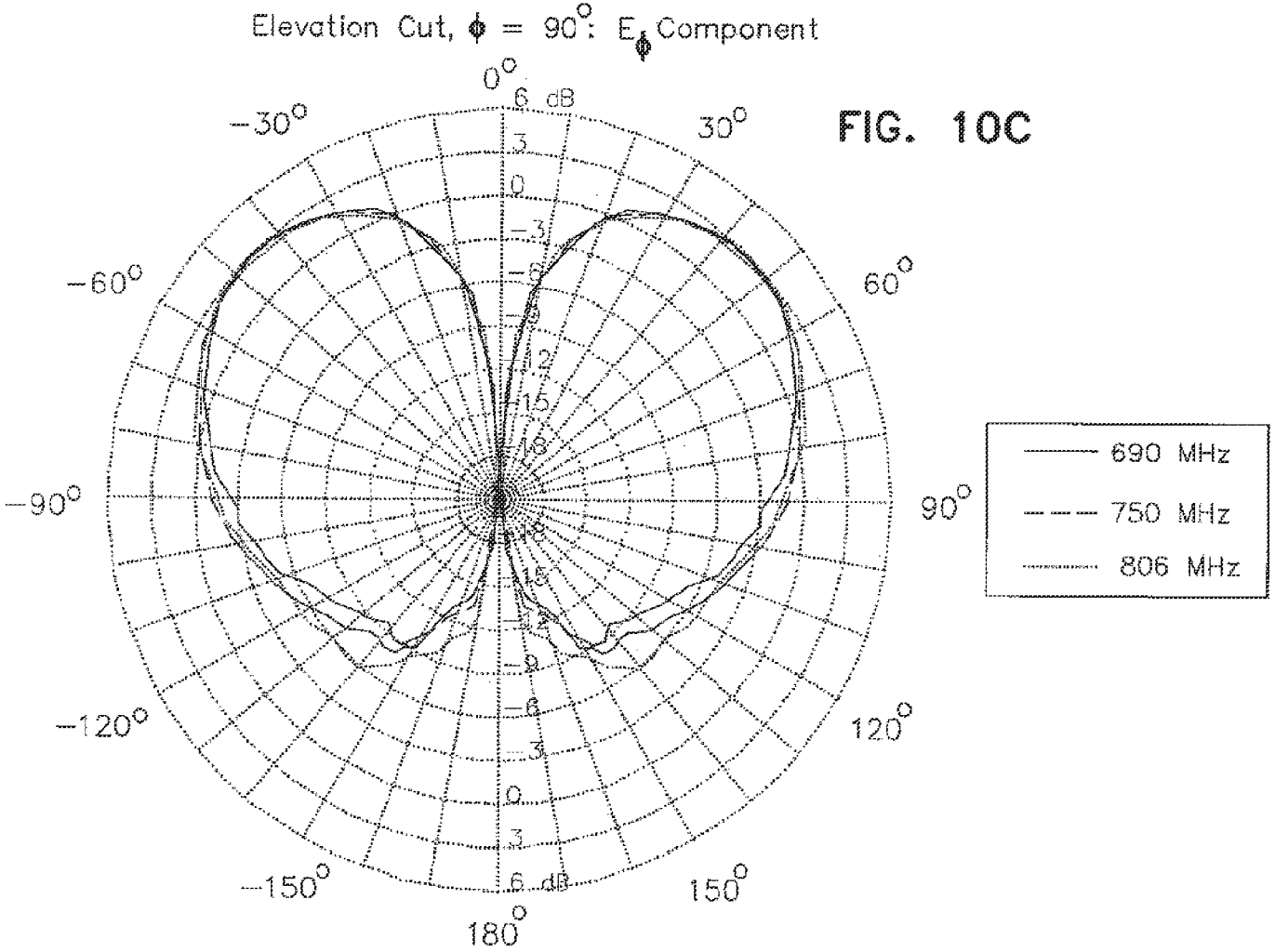

Reference is now made to FIGS. 9A, 9B and 9C, which are simplified graphs respectively showing an azimuth cut and two elevation cuts of radiation patterns of a vertically polarized radiating element in an antenna of the type illustrated in FIGS. 1-2C; and to FIGS. 10A, 10B and 10C, which are simplified graphs respectively showing an azimuth cut and two elevation cuts of radiation patterns of horizontally polarized radiating elements in an antenna of the type illustrated in FIGS. 1-2C.

As seen in FIGS. 9A and 10A, both the vertically and horizontally polarized radiating elements have omnidirectional radiation patterns over a range of operating frequencies.

As seen in FIGS. 9B, 9C, 10B and 10C, both the vertically and horizontally polarized radiating elements have conical radiation patterns. As apparent from a comparison of FIGS. 9B and 9C, corresponding to elevation cuts of the radiation patterns of the vertically polarized monopole, to FIGS. 10B and 10C, corresponding to elevation cuts of the radiation patterns of the horizontally polarized dipoles, the radiation patterns of the vertically and horizontally polarized radiating elements are very similar over the measured frequencies. As a result, the antenna of FIGS. 1-2C provides balanced horizontally and vertically polarized coverage over its operating environment, making it well suited for MIMO applications.

Return Loss and Isolation

Figure 11A:
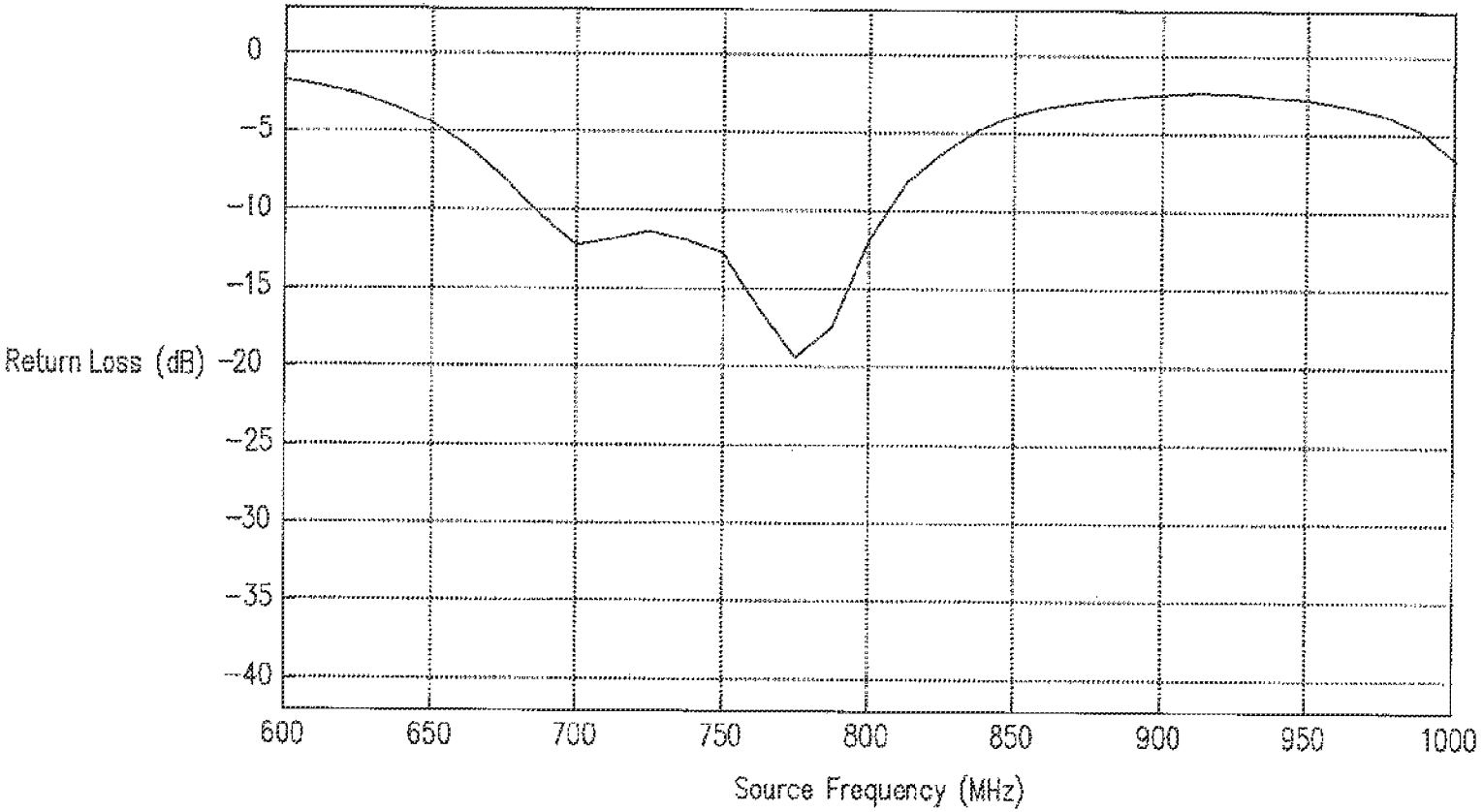
FIGS. 11A, 11B and 11C are simplified graphs respectively showing a return loss of horizontally polarized radiating elements and of a vertically polarized radiating element and the isolation therebetween in an antenna of the type illustrated in FIGS. 1-2C.
Figure 11B:
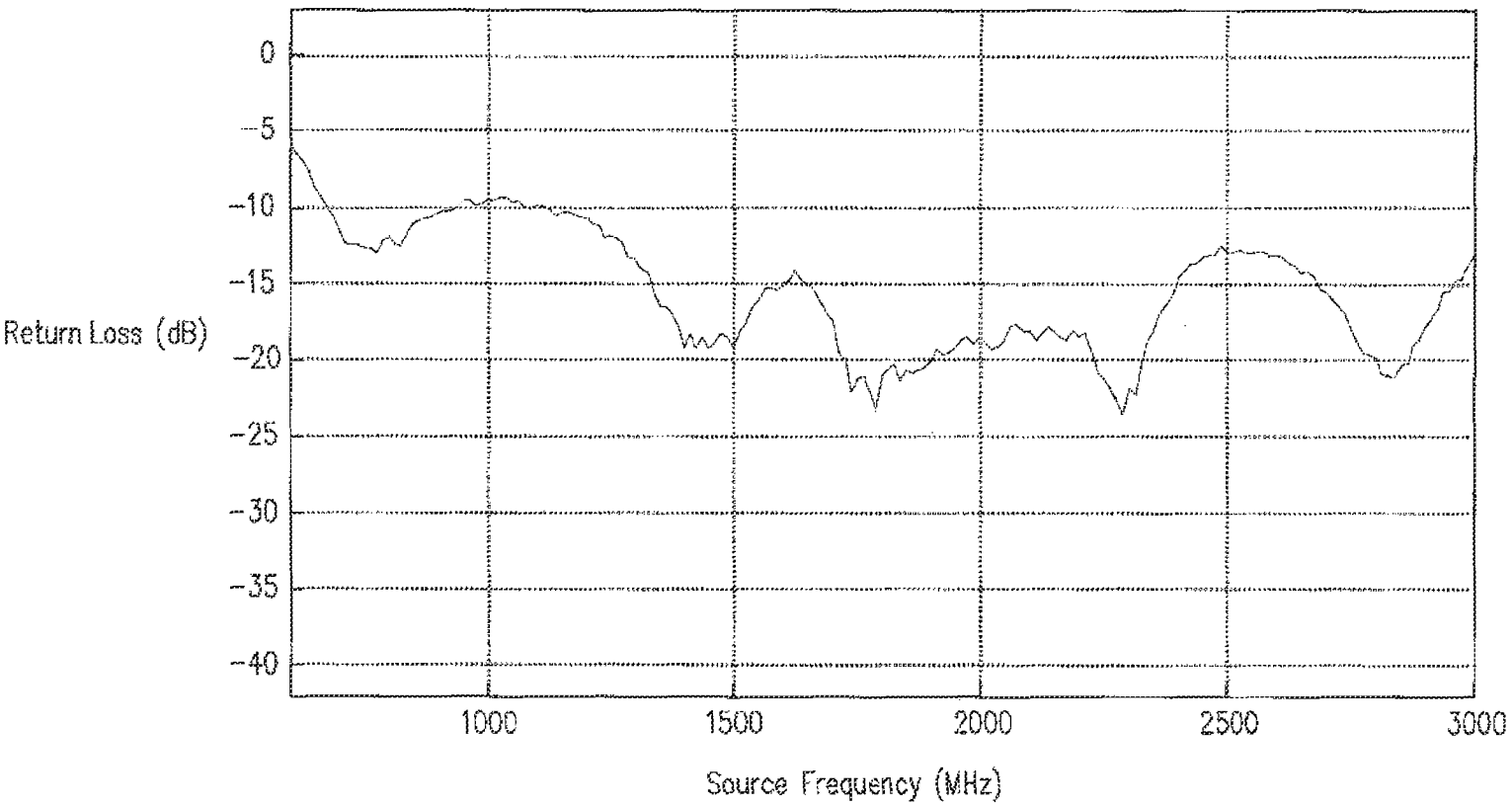
Figure 11C:
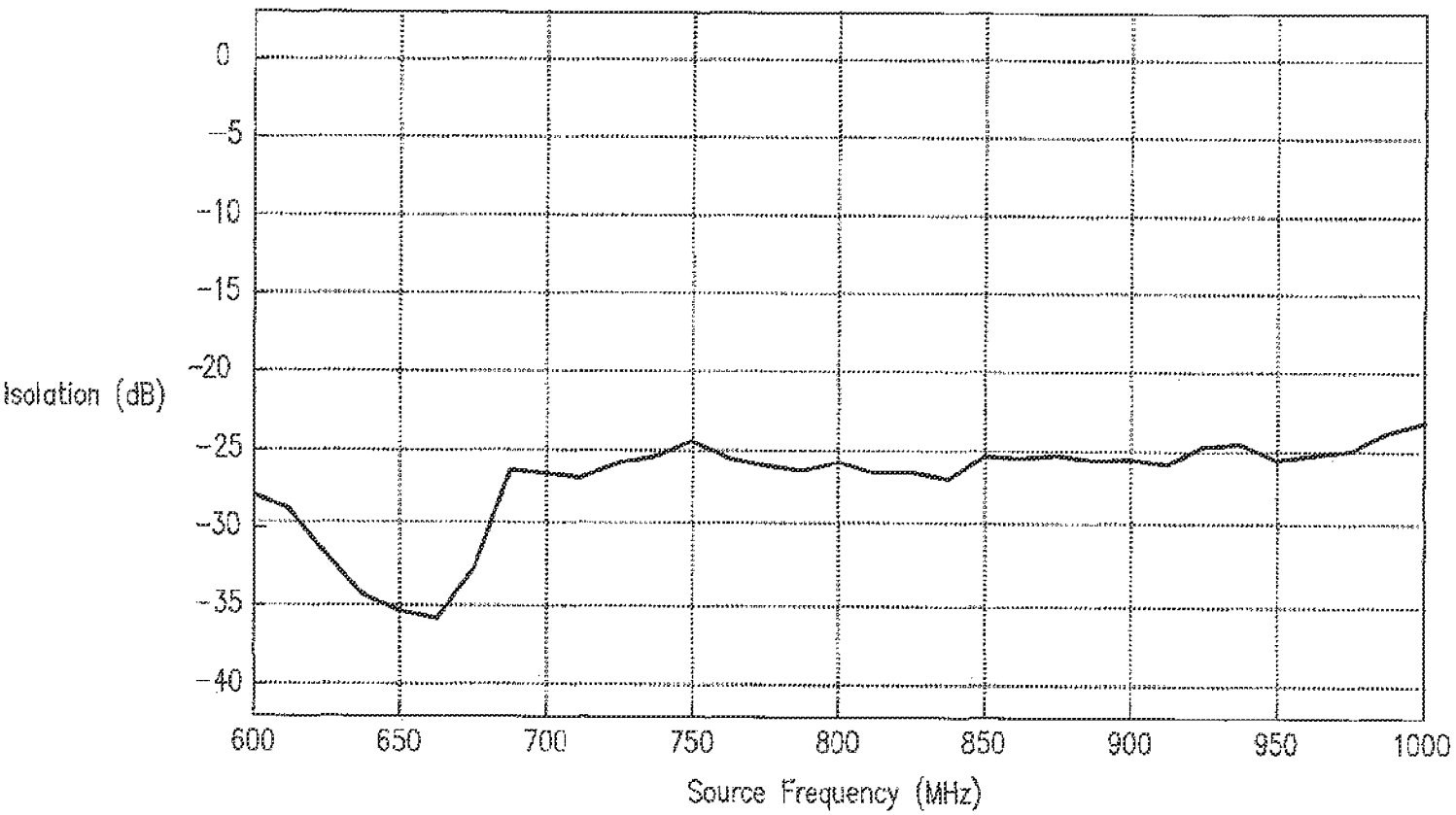

Reference is now made to FIGS. 11A, 11B and 11C which are simplified graphs respectively showing the return loss of horizontally polarized radiating elements and of a vertically polarized radiating element and the isolation therebetween in an antenna of the type illustrated in FIGS. 1-2C.

As seen in FIG. 11A, the return loss of the horizontally polarized dipole array is better than −10 dB in a frequency range of 698-806 MHz. The inherently broadband performance of the horizontally polarized dipole array is indicated by the broad minima of the graph, spanning a frequency range of approximately 698-806 MHz.

As seen in FIG. 11B, the return loss of the vertically polarized monopole is better than −10 dB in a frequency range of 698-960 MHz. The broadband performance of the vertically polarized monopole is indicated by the broad minima of the graph, spanning a frequency range of approximately 698-2700 Mhz.

As seen in FIG. 11C, the isolation between the vertically polarized monopole and horizontally polarized dipole array is better than −20 dB. As described above, the good isolation between the vertically and horizontally polarized radiating elements in the antenna of the present invention is attributable to a number of preferred features of the antenna, including the mutually orthogonal polarizations of the horizontally and vertically polarized radiating elements, the arrangement of the reflector and the multi-planar configuration of the feed network. The isolation between the vertically and horizontally polarized radiating elements is also influenced by the separation between the vertically polarized monopole radiating element and the horizontally polarized radiating elements.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna, comprising:

a broadband vertically polarized monopole radiating element;

a reflector having a projection in a first plane generally perpendicular to a vertical axis of said monopole radiating element;

a plurality of horizontally polarized radiating elements arranged generally concentrically with respect to said monopole radiating element, each one of said horizontally polarized radiating elements having a projection in a second plane generally perpendicular to said vertical axis, said second plane being offset from said first plane in a direction along said vertical axis; and a feed arrangement for feeding said monopole and horizontally polarized radiating elements, wherein said monopole radiating element comprises a conical radiating element, and wherein said conical radiating element comprises an upper conductive cylindrical element and a lower conductive conical element, said upper cylindrical and lower conical elements being held in a partially overlapping configuration by means of an inner spacer element and an outer supporting stand.

2. An antenna according to claim 1, wherein said plurality of horizontally polarized radiating elements comprises an array of horizontally polarized radiating elements.

3. An antenna according to claim 2, wherein said array of horizontally polarized radiating elements comprises an array of horizontally polarized dipoles.

4. An antenna according to claim 3, wherein said array comprises four dipoles arranged in a square-like configuration.

5. An antenna according to claim 1, wherein said plurality of horizontally polarized radiating elements is perpendicular to said vertical axis.

6. An antenna according to claim 1, wherein said monopole radiating element radiates a vertically polarized conical omnidirectional beam.

7. An antenna according to claim 6, wherein said plurality of horizontally polarized radiating elements radiates a horizontally polarized conical omnidirectional beam.

8. An antenna according to claim 1, wherein said reflector comprises a ground plane.

9. An antenna according to claim 8, wherein said reflector is planar.

10. An antenna according to claim 1, wherein said feed arrangement comprises a first port for feeding said monopole radiating element and a second port for feeding said plurality of horizontally polarized radiating elements.

11. An antenna according to claim 10, wherein said first port is galvanically connected to said monopole radiating element.

12. An antenna according to claim 10, wherein said second port is connected to a common feed network feeding said plurality of horizontally polarized radiating elements.

13. An antenna according to claim 12, wherein said feed network comprises a multi-planar feed network.

14. An antenna, comprising:

a broadband vertically polarized monopole radiating element;

a reflector having a projection in a first plane generally perpendicular to a vertical axis of said monopole radiating element;

a plurality of horizontally polarized radiating elements arranged generally concentrically with respect to said monopole radiating element, each one of said horizontally polarized radiating elements having a projection in a second plane generally perpendicular to said vertical axis, said second plane being offset from said first plane in a direction along said vertical axis;

a feed arrangement for feeding said monopole and horizontally polarized radiating elements; and a second plurality of horizontally polarized radiating elements arranged generally concentrically with respect to said monopole radiating element, each one of said horizontally polarized radiating elements having a projection in a third plane generally perpendicular to said vertical axis, said third plane being offset from said first and said second planes in a direction along said vertical axis.

15. An antenna according to claim 14, wherein said antenna comprises a multiband antenna.

16. An antenna according to claim 14, wherein said second plurality of horizontally polarized radiating elements comprises an array of horizontally polarized radiating elements.

17. An antenna according to claim 16, wherein said horizontally polarized radiating elements comprise dipoles.

18. An antenna according to claim 14, wherein said monopole radiating element comprises a conical radiating element.

19. An antenna according to claim 14, wherein said monopole radiating element comprises an upstanding multi-branched structure.

* * * * *